US010451362B2

(12) United States Patent
Kinder et al.

(10) Patent No.: US 10,451,362 B2
(45) Date of Patent: Oct. 22, 2019

(54) HEAT EXCHANGER HAVING BYPASS SEAL WITH RETENTION CLIP

(71) Applicant: Dana Canada Corporation, Oakville (CA)

(72) Inventors: Lee M. Kinder, Oakville (CA); Kenneth M. A. Abels, Oakville (CA); Colin A. Shore, Hamilton (CA); Eric J. Schouten, Hamilton (CA)

(73) Assignee: Dana Canada Corporation, Oakville, ON (CA)

( * ) Notice: Subject to any disclaimer, the term of this patent is extended or adjusted under 35 U.S.C. 154(b) by 18 days.

(21) Appl. No.: 15/783,337

(22) Filed: Oct. 13, 2017

(65) Prior Publication Data

US 2018/0128555 A1 May 10, 2018

Related U.S. Application Data

(60) Provisional application No. 62/408,216, filed on Oct. 14, 2016.

(51) Int. Cl.
*F28F 9/00* (2006.01)
*F28D 9/00* (2006.01)
(Continued)

(52) U.S. Cl.
CPC ..... *F28F 9/005* (2013.01); *F02B 29/0462* (2013.01); *F28D 9/0006* (2013.01); *F28D 9/0043* (2013.01); *F28D 9/0056* (2013.01); *F28D 9/0075* (2013.01); *F28F 3/027* (2013.01); *F28F 9/001* (2013.01); *F28F 9/0075* (2013.01); *F28D 2021/0082* (2013.01); *F28F 2230/00* (2013.01)

(58) Field of Classification Search
CPC .. F28F 9/005; F28F 3/027; F28F 9/001; F28F 9/0075; F28F 2230/00; F02B 29/0462; F28D 9/0006; F28D 9/0043; F28D 9/0056; F28D 9/0075; F28D 2021/0082
USPC ..... 165/74
See application file for complete search history.

(56) References Cited

U.S. PATENT DOCUMENTS 4,095,646 A 6/1978 Granetzke
4,116,271 A 9/1978 De Lepeleire
(Continued)

FOREIGN PATENT DOCUMENTS

WO 20150164968 11/2015

OTHER PUBLICATIONS

International Search Report and Written Opinion for Application No. PCT/CA2017/051222, dated Jan. 15, 2018.

*Primary Examiner* — Raheena R Malik
(74) *Attorney, Agent, or Firm* — Marshall & Melhorn, LLC

(57) ABSTRACT

A heat exchanger comprises a stack of flat tubes defining first and second fluid flow passages, and a housing having side covers over the sides of the core, and being spaced from the sides of the core. The heat exchanger further comprises a bypass seal comprising a pair of side seals and a pair of clip members. The side seals are received between the sides of the core and the housing. Each side seal has an inner surface engaging the first side of the core and an outer surface engaging the first side wall of the housing. Each clip member has a middle portion to which a side seal is connected, as well as opposed first and second end portions which engage inwardly extending surfaces of the core.

22 Claims, 16 Drawing Sheets

(51) Int. Cl.

| | |
|---|---|
| ***F02B 29/04*** | (2006.01) |
| ***F28F 3/02*** | (2006.01) |
| ***F28F 9/007*** | (2006.01) |
| *F28D 21/00* | (2006.01) |

(56) References Cited

U.S. PATENT DOCUMENTS

| | | | | |
|---|---|---|---|---|
| 4,139,054 | A | 2/1979 | Anderson | |
| 4,219,079 | A | 8/1980 | Sumitomo | |
| 4,579,172 | A | 4/1986 | Carlsson | |
| 4,966,231 | A | 10/1990 | Belcher et al. | |
| RE35,890 | E | 9/1998 | So | |
| 6,273,183 | B1 | 8/2001 | So et al. | |
| 6,357,396 | B1 | 3/2002 | Stansfield et al. | |
| 6,474,408 | B1 * | 11/2002 | Yeh | F28D 9/0043 165/82 |
| 6,976,531 | B2 * | 12/2005 | Martin | F28D 9/0043 165/167 |
| 8,365,411 | B2 * | 2/2013 | Saito | B21D 5/015 29/897.2 |
| 8,789,832 | B2 | 7/2014 | Gabert | |
| 9,291,068 | B2 | 3/2016 | Roge et al. | |
| 2007/0181105 | A1 * | 8/2007 | Bazika | F02B 29/0462 123/563 |
| 2008/0110595 | A1 | 5/2008 | Palanchon | |
| 2011/0006488 | A1 | 3/2011 | Belser et al. | |
| 2014/0246186 | A1 * | 9/2014 | Bruggesser | F02B 29/0462 165/168 |
| 2014/0311142 | A1 | 10/2014 | Speidel et al. | |
| 2014/0311143 | A1 | 10/2014 | Speidel et al. | |
| 2014/0345577 | A1 * | 11/2014 | Meshenky | F02M 35/112 123/542 |
| 2015/0068717 | A1 * | 3/2015 | Gluck | B21D 53/04 165/166 |
| 2015/0285572 | A1 * | 10/2015 | Fleitling | F28F 3/025 165/167 |
| 2015/0354900 | A1 | 12/2015 | Duerr et al. | |
| 2016/0097596 | A1 | 4/2016 | Stewart et al. | |
| 2016/0375742 | A1 | 12/2016 | Chiba | |

* cited by examiner 122
192
142
125
180
124
150
82
84
154
156
120

HEAT EXCHANGER HAVING BYPASS SEAL WITH RETENTION CLIP

CROSS-REFERENCE TO RELATED APPLICATION

This application claims priority to and the benefit of U.S. Provisional Patent Application No. 62/408,216 filed Oct. 14, 2016, the contents of which are incorporated herein by reference.

FIELD OF THE INVENTION

The invention generally relates to heat exchangers for cooling a hot gas with a coolant, such as gas-liquid charge air coolers having a housing enclosing a heat exchanger core, with a seal being provided to reduce bypass flow between the core and the housing.

BACKGROUND

It is known to use gas-liquid heat exchangers to cool compressed charge air in turbocharged internal combustion engines or in fuel cell engines, or to cool hot engine exhaust gases. For example, compressed charge air is typically produced by compressing ambient air. During compression, the air can be heated to a temperature of about 200° C. or higher, and must be cooled before it reaches the engine.

Various constructions of gas-cooling heat exchangers are known. For example, gas-cooling heat exchangers commonly have an aluminum core comprised of a stack of tubes or plate pairs, with each tube or plate pair defining an internal coolant passage. The tubes or plate pairs are spaced apart to define gas flow passages which are typically provided with turbulence-enhancing inserts to improve heat transfer from the hot gas to the liquid coolant.

In some gas-liquid charge air coolers, the aluminum core is enclosed within a housing, which is typically formed from a dissimilar material such as plastic. The housing typically includes coolant inlet and outlet openings which are sealingly connected to the coolant passages within the tubes or plate pairs. The housing also includes gas inlet and outlet openings and provides manifold spaces for the gas flow, and the gas flow passages of the core are open to the interior of the housing.

Typically there are gaps between the heat exchanger core and the housing. Along the sides of the core, the presence of these gaps is due partly to spacing between the tubes or plate pairs and the interior of the housing, and partly due to spacing between the edges of the turbulence-enhancing inserts and the interior of the housing. If left open, the gaps along the sides of the core will permit excessive bypass flow of the hot charge air, reducing the efficiency of the heat exchanger. Therefore, it is common for the housing to include bypass blocking elements to reduce bypass flow of the hot charge air.

Such bypass blocking elements may have a comb-like profile with fingers extending into the spaces between the tubes or plate pairs. A heat exchanger with bypass blocking elements of this type is described in commonly assigned International Publication No. WO 2015/164968 A1, which is incorporated herein by reference in its entirety.

Another type of bypass blocking element is disclosed in commonly assigned US Publication No. US 2016/0097596 A1, which is incorporated by reference in its entirety.

Disclosed therein is a self-retaining bypass seal including side seals which are recessed into channels formed in the core.

There remains a need for gas-cooling heat exchangers which provide high reliability while avoiding excessive material and/or manufacturing costs, and for such a heat exchanger having a bypass seal which effectively blocks bypass flow, which is simple to manufacture and which will remain in place during manufacture and use of the heat exchanger.

SUMMARY

In one aspect, there is provided a heat exchanger comprising a core, a housing and a bypass seal.

The core comprises a plurality of first fluid flow passages for flow of a first fluid and a plurality of second fluid flow passages for flow of a second fluid. The first and second fluid flow passages are arranged in alternating order along a height of the core. The core has a top and an opposed bottom, and a first side and an opposed second side, the first and second sides each extending between the top and the bottom along the height of the core, wherein the top, the bottom and the sides extend at least generally along an axis defined by a flow direction of the first fluid.

The core further comprises a first end and an opposed second end spaced apart along the axis; a first fluid inlet and a first fluid outlet, each of the first fluid inlet and the first fluid outlet being located in one of the first and second ends of the core, and facing the axis. Each of the first fluid flow passages has opposed first and second sides which are substantially closed, wherein a first side plane passes through at least some of the first sides of the first fluid flow passages, and a second side plane passes through at least some of the second sides of the first fluid flow passages.

The first side of the core defines a first inwardly extending surface and a second inwardly extending surface which are spaced apart along the height of the core, and both the first and second inwardly extending surfaces extend inwardly of the first side plane toward the second side plane. The second side of the core defines a third inwardly extending surface and a fourth inwardly extending surface which are spaced apart along the height of the core, and both the third and fourth inwardly extending surfaces extend inwardly of the second side plane toward the first side plane.

The housing comprises a top wall and an opposed bottom wall, and a first side wall and an opposed second side wall, wherein the side walls extend between the top wall and the bottom wall. The first side wall of the housing is spaced from the first side of the core and from the first side plane, and the second side wall of the housing is spaced from the second side of the core and from the second side plane.

The bypass seal comprises a first side seal portion received between the first side of the core and the first side wall of the housing, wherein the first side seal portion has an inner surface engaging the first side of the core and an outer surface engaging the first side wall of the housing; and a first clip member having a middle portion, a first end portion and an opposed second end portion. The middle portion is received between the first side of the core and the first side wall of the housing, the first end portion extending inwardly of the first side plane of the core and engaging the first inwardly extending surface, and the second end portion extending inwardly of the first side plane of the core and engaging the second inwardly extending surface, wherein the first side seal portion is connected to the middle portion of the first clip member.

The bypass seal further comprises a second side seal portion received between the second side of the core and the second side wall of the housing, wherein the second side seal portion has an inner surface engaging the second side of the core and an outer surface engaging the second side wall of the housing; and a second clip member having a middle portion, a first end portion and an opposed second end portion. The middle portion is received between the second side of the core and the second side wall of the housing, the first end portion extending inwardly of the second side plane of the core and engaging the third inwardly extending surface, and the second end portion extending inwardly of the second side plane of the core and engaging the fourth inwardly extending surface, wherein the second side seal portion is connected to the middle portion of the second clip member.

In an embodiment, the top wall of the housing is spaced from the top of the core, and the bypass seal further comprises: a top seal portion received between the top of the core and the top wall of the housing, wherein the top seal portion has an inner surface engaging the top of the core and an outer surface engaging the top wall of the housing.

In an embodiment, the top seal portion has one end which is connected to the first side seal portion and another end which is connected to the second side seal portion. In an embodiment, at least the outer surface of the top seal portion is comprised of a resilient, foamed polymeric material. In an embodiment, the top seal includes one or more slotted tabs, and the top of the core includes one or more projections; wherein each of the one or more projections is received in one of the one or more slotted tabs; and wherein the one or more slotted tabs are substantially co-planar with the inner surface of the top seal, and project therefrom along the axis, toward the first end of the core, wherein the first fluid inlet is located at the first end of the core.

In an embodiment, the first clip member and the second clip member are comprised of plastic or metal, and wherein one or both of the first side seal portion and the second side seal portion are comprised of a resilient, foamed polymeric material.

In an embodiment, the first clip member and the second clip member are each comprised of an aluminum alloy, wherein the first and second end portions of the first clip member are brazed to the respective first and second inwardly extending surfaces of the core, and wherein the first and second end portions of the second clip member are brazed to the respective third and fourth inwardly extending surfaces of the core.

In an embodiment, the second end portions of the first and second clip members each comprise a contact portion engaging the core and an arcuate portion which is connected to the contact portion, which is spaced from the core, and which extends between the contact portion and the middle portion of the clip member. In an embodiment, the second and fourth inwardly extending surfaces are each provided with a local projection protruding therefrom along the height of the core, wherein each said projection is located laterally between the contact portion of the first or second clip member and the respective first or second side plane.

In an embodiment, the first and third inwardly extending surfaces are each provided with one or more slots facing toward the respective first and second side planes, wherein each of the slots are axially spaced from the first and second side seal portions, and wherein the first end portion of each of the first and second clip members has an axially extending tip portion which is received within one of the slots. In an embodiment, the slots are diagonally oriented relative to the axis. In an embodiment, each of the first and third inwardly extending surfaces has a pair of slots, wherein the slots of each said pair are axially spaced apart and located on either side of the respective first and second side seal portions, and wherein the first end portion of each of the first and second clip members is flat and planar and has a pair of said tip portions extending axially in opposite directions and each received inside one of the slots.

In an embodiment, the middle portion of each of the first and second clip members includes one or more apertures, and wherein the first and second side seal portions each have one or more inwardly extending projections extending through and being retained by one of the one or more apertures of the middle portion.

In an embodiment, each of the first and second side seal portions includes an inner portion including the inner surface and an outer portion including the outer surface; wherein the inner portions of the first and second side seal portions are integrally formed with the respective first and second clip members; wherein the outer portions of the first and second side seal portions are integrally formed with the top seal portion; and wherein the inner and outer portions of each of the first and second side seal portions are connected together by connecting elements. In an embodiment, the first and second side seal portions are integrally formed with the respective first and second clip members.

In an embodiment, the core includes a top plate which defines the top of the core and a bottom plate which defines the bottom of the core, and wherein the first and third inwardly extending surfaces are located on the top plate, and the second and fourth inwardly extending surfaces are located on the bottom plate. In an embodiment, the bottom wall of the housing comprises a flange plate having a central portion and an upstanding peripheral flange, wherein the central portion is secured to the bottom plate of the core and the upstanding flange is spaced from the second and fourth inwardly extending surfaces, such that the second end portion of the first clip member is located between the upstanding flange and the second inwardly extending surface, and the second end portion of the second clip member is located between the upstanding flange and the fourth inwardly extending surface.

In an embodiment, the bypass seal further comprises a resilient bottom seal portion received between the upstanding flange of the flange plate and the bottom plate of the core, wherein the bottom seal portion has an inner surface engaging the bottom plate and an outer surface engaging the upstanding flange. In an embodiment, the resilient bottom seal portion has one end which is connected to the first side seal portion and another end which is connected to the second side seal portion.

In an embodiment, the first fluid inlet is provided at the first end of the core and the first fluid outlet is provided at the second end of the core, and wherein the bypass seal is provided proximate to the first end of the core.

In an embodiment, each of the second fluid flow passages has opposed first and second sides which are substantially closed; wherein the first sides extend outwardly of the first side plane toward the first side wall of the housing, and wherein the second sides extend outwardly of the second side plane toward the second side wall of the housing; and wherein the inner surface of each of the first and second side seal portions includes a plurality of recesses to receive the first and second sides of the second fluid flow passages.

BRIEF DESCRIPTION OF THE DRAWINGS

The invention will now be described, by way of example only, with reference to the accompanying drawings, in which.

DETAILED DESCRIPTION

Figure 1:
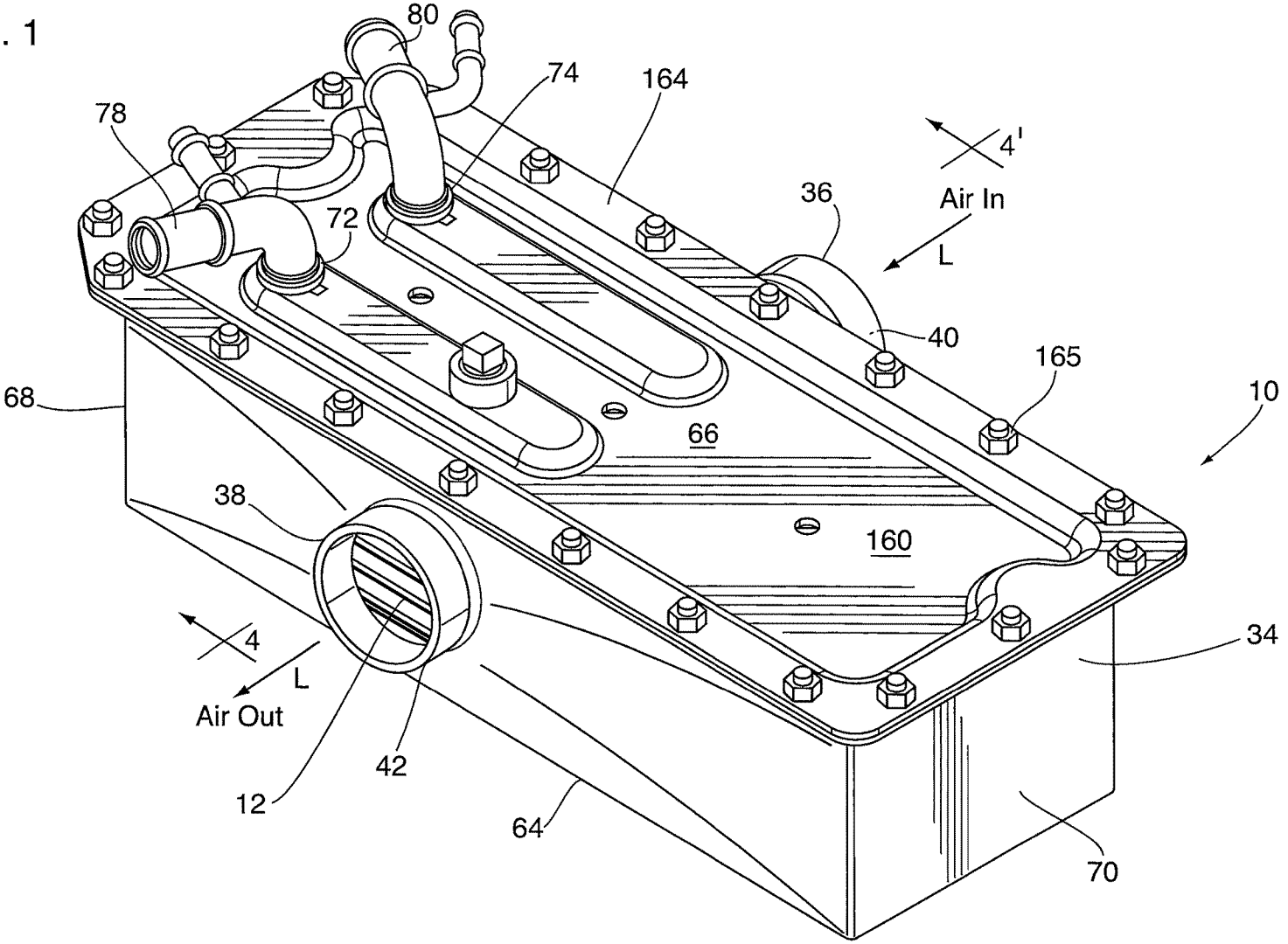
FIG. 1 is a perspective view showing the exterior of a heat exchanger according to a first embodiment disclosed herein.

A heat exchanger 10 according to a first embodiment is now described below with reference to FIGS. 1 to 10.

The terms "top" and "bottom" are used herein as terms of convenience, and do not indicate that the heat exchangers described herein are required to have any particular orientation in use.

Heat exchanger 10 comprises a heat exchanger core 12 comprising a plurality of first fluid flow passages 52 for flow of a first fluid and a plurality of second fluid flow passages 50 for flow of a second fluid, the first and second fluid flow passages 52, 50 arranged in alternating order along a height H of the core 12.

In the present embodiment, heat exchanger 10 is a charge air cooler for a motor vehicle powered by an engine requiring compressed charge air, such as a turbocharged internal combustion engine or a fuel cell engine. Therefore, in the present embodiment, the first fluid is charge air which flows through the first fluid flow passages 52. Therefore, the first fluid flow passages 52 are sometimes referred to in the present description as "gas flow passages 52" and the first fluid is sometimes referred to as "gas", "air" or "charge air". In the present embodiment, a liquid coolant is circulated through the second fluid flow passages 50 of core 12. Therefore, the second fluid flow passages 50 are sometimes referred to in the present description as "liquid flow passages 50" or "coolant flow passages 50", and the second fluid is sometimes referred to as "liquid" or "coolant". The coolant may be the same as the engine coolant, and may comprise water or a water/glycol mixture.

The heat exchanger 10 may be mounted downstream of an air compressor and upstream of an air intake manifold of the engine to cool the hot, compressed charge air before it reaches the engine. However, in some embodiments the heat exchanger 10 may be integrated with the intake manifold, as further discussed below.

The heat exchanger core 12 has a top 14, a bottom 16, first and second sides 18, 20 each extending between the top 14 and bottom 16 along the height H of the core, wherein the top 14, bottom 16 and sides 18, 20 extend at least generally along an axis L defined by a flow direction of the first fluid.

The core 12 has a first end 22 and an opposed second end 24 which are spaced apart along axis L, wherein the first end 22 is located upstream of the second end 24. The core 12 also has a first fluid inlet 30 and a first fluid outlet 32, each of which is located in one of the first and second ends 22, 24 of the core 12, and at least generally facing in the direction of axis L. In the present embodiment, the first fluid inlet 30 is provided at the first end 22 of the core 12, and the first fluid outlet 32 is provided at the second end 24.

It can be seen that the top 14, bottom 16 and sides 18, 20 extend substantially parallel to the axis L, and the overall shape of the core 12 is that of a rectangular prism in which the width of the core 12 transverse to axis L is greater than the length of core 12 along axis L. However, the specific dimensions of the core 12 shown in the drawings are not essential, and can be varied. For example, the width and length of the core may be similar or the same, or the length may be greater than the width.

The core 12 also includes coolant openings 25, 27 and respective coolant manifolds 54, 56 which are in flow communication with the second fluid flow passages 50.

It will be appreciated that the specific arrangement and locations of the inlet and outlet openings for air and coolant will at least partially depend on the specific configuration of a vehicle's air intake system, and will vary from one application to another.

The core 12 of heat exchanger 10 will typically be comprised of a metal such as aluminum or an aluminum alloy, with the components of core 12 being joined together by brazing. As used in relation to all embodiments described herein, the term "aluminum" is intended to include aluminum and its alloys. It will be appreciated that aluminum construction is not essential, and that the core 12 can be made of other metals, such as stainless steel.

The structure of the core 12 is variable, and the specific construction according to the present embodiment is only one example of a possible core construction. Core 12 comprises a stack of flat tubes 48, each having a hollow interior defining a second fluid flow passage 50, and with opposed first and second sides 26, 28 extending along the length L of the core 12 and partly defining the sides 18, 20 of core 12.

Figure 2:
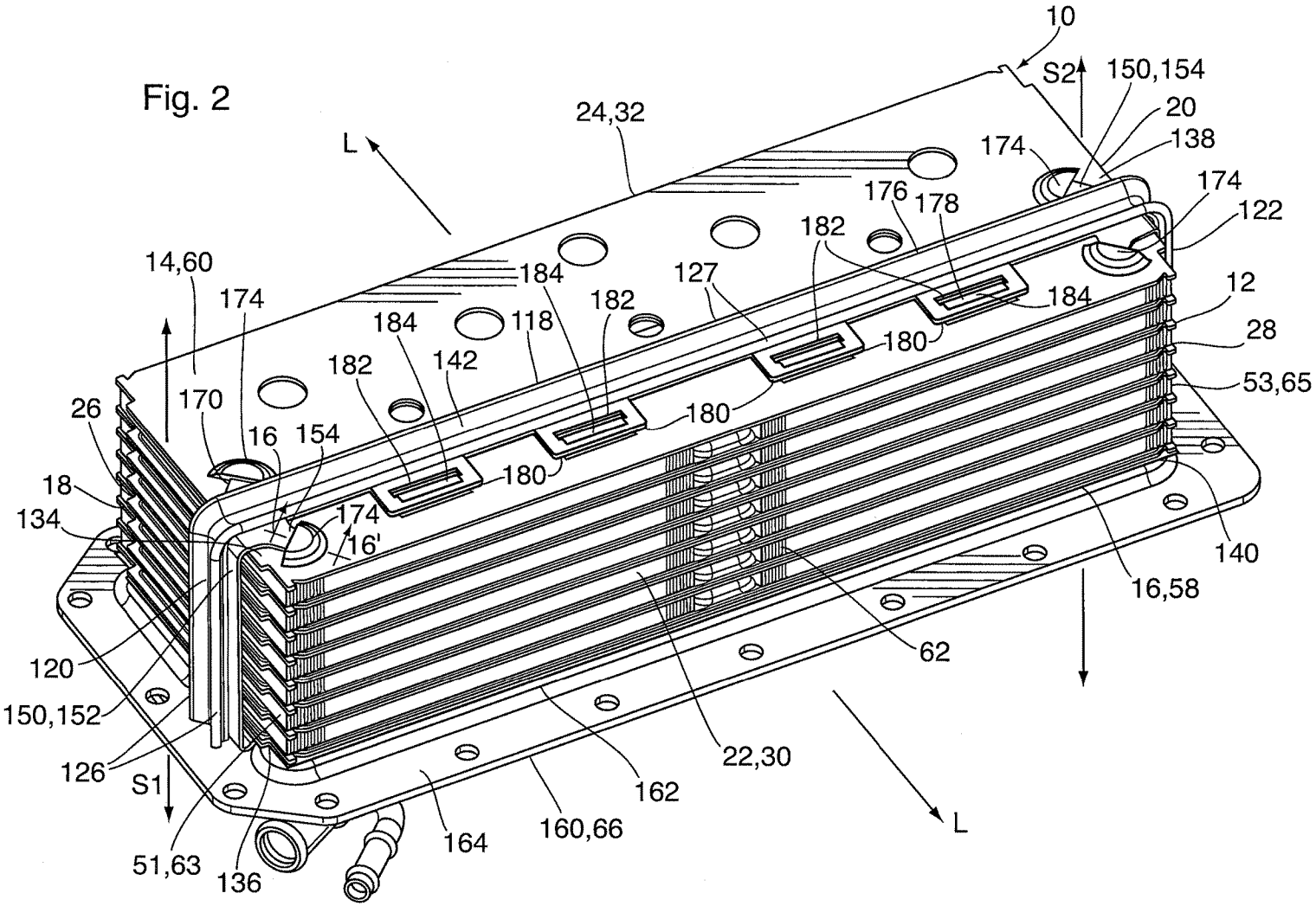
FIG. 2 is a top perspective view of the heat exchanger of FIG. 1, with a portion of the housing removed.
Figure 3:
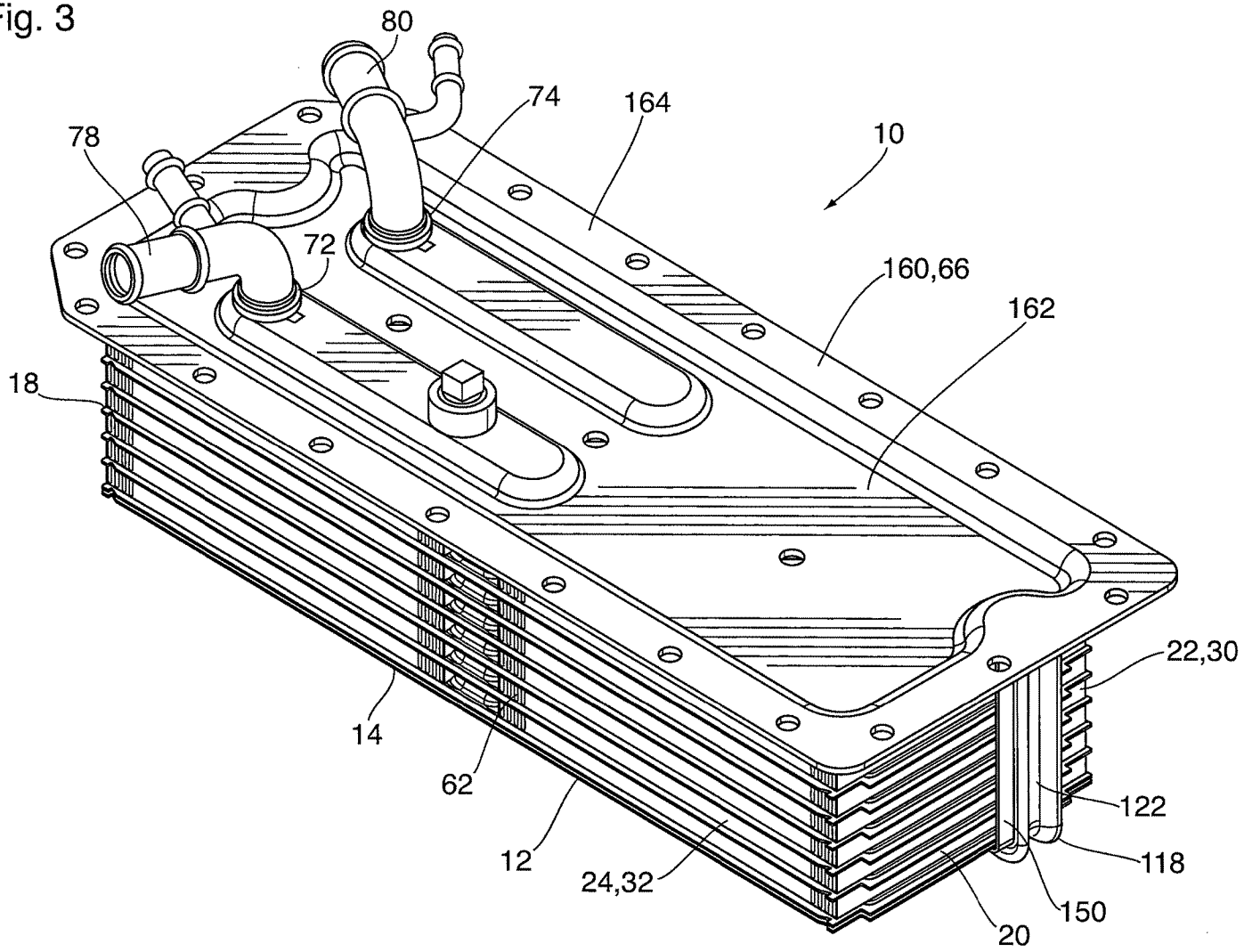
FIG. 3 is a bottom perspective view of the heat exchanger of FIG. 1, with a portion of the housing removed.

The flat tubes 48 are arranged in a stack with spaces provided between adjacent pairs of the flat tubes 48, each of these spaces defining a first fluid flow passage 52 extending from the first end 22 to the second end 24 of core 12, along the axis L. As will be appreciated, each of the first fluid flow passages 52 has a pair of open ends proximate to the ends 22, 24 of core 12, and a pair of opposed sides, namely a first side 51 and second side 53 which are substantially closed and extend along the axis L. The opposed first and second sides 51, 53 of the gas flow passages 52 partly define the sides 18, 20 of the core 12. As shown in FIG. 2, a first side plane S1 passes through at least some of the first sides 51 of the first fluid flow passages 52, and a second side plane S2 passes through at least some of the second sides 53 of the first fluid flow passages 52.

The gas flow passages 52 extending lengthwise through core 12 may be provided with turbulence-enhancing inserts such as corrugated fins or turbulizers in order to provide increased turbulence and surface area for heat transfer, and to provide structural support for the core 12. In the illustrated embodiment, the turbulence-enhancing inserts comprise a plurality of corrugated fins 62, in which the sidewalls 44 defining the corrugations extend along axis L, the corrugations being open at the first and second ends 22, 24 of core 12.

Each of the corrugated fins 62 has a pair of opposed sides 63, 65, each of which comprises the sidewall 44 of one of the corrugations of a fin 62. Side 63 defines the first side 51 of one of the first fluid flow passages 52 and side 65 defines the second side 53 of one of the first fluid flow passages 52, and therefore the first side plane S1 passes through at least some of the sides 63 of corrugated fins 62, and the second side plane S2 passes through at least some of the sides 65 of corrugated fins 62. The sides 63, 65 may be substantially closed and bonded at their upper and lower edges to flat tubes 48.

As used herein, the terms "fin" and "turbulizer" are intended to refer to corrugated turbulence-enhancing inserts having a plurality of axially-extending ridges or crests connected by sidewalls, with the ridges being rounded or flat. As defined herein, a "fin" has continuous ridges whereas a "turbulizer" has ridges which are interrupted along their length, so that axial flow through the turbulizer is tortuous. Turbulizers are sometimes referred to as offset or lanced strip fins, and examples of such turbulizers are described in U.S. Pat. No. Re. 35,890 (So) and U.S. Pat. No. 6,273,183 (So et al.). The patents to So and So et al. are incorporated herein by reference in their entireties.

It is advantageous that at least the endmost sidewalls 44 located at the first and second sides 63, 65 of each corrugated fin 62 are substantially free of perforations so as to minimize the amount of gas which will escape from and bypass the corrugated fin 62. In embodiments where it is desired to provide the sidewalls 44 of fins 62 with louvers or other types of perforations (not shown), at least the endmost sidewall 44 may be deformed so as to substantially close the perforations, or the corrugated fin 62 may be provided in multiple sections, including a central section with louvers or other perforations, and one or two edge sections located along which are free from perforations. However, it will be appreciated that the sidewalls 44 of fins 62 along side edges 63, 65 may have perforations such as louvers, and that such perforations may be provided in all the sidewalls 44 of corrugated fin 62.

Figure 5:
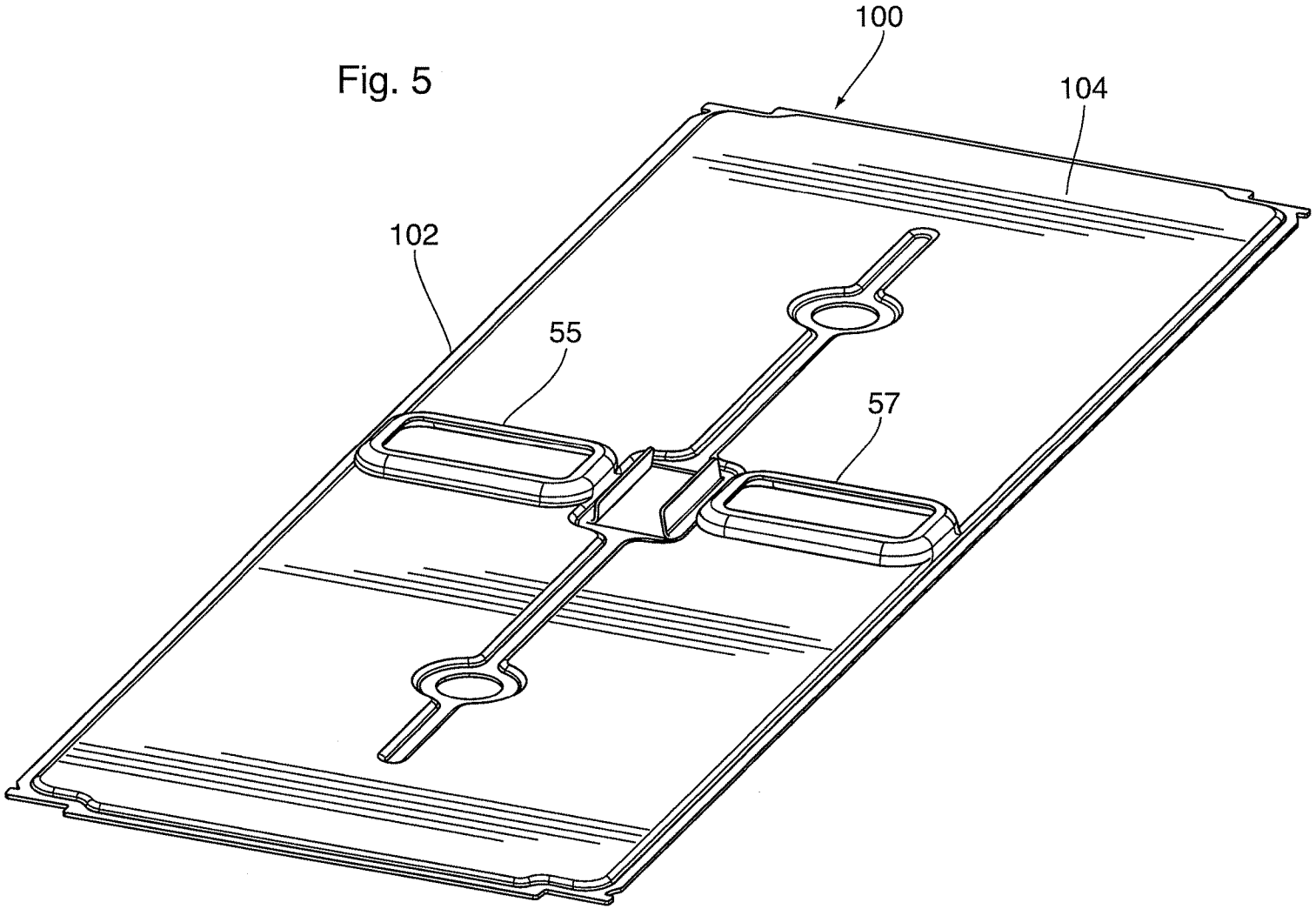
FIG. 5 is a top perspective view of a core plate.
Figure 6:
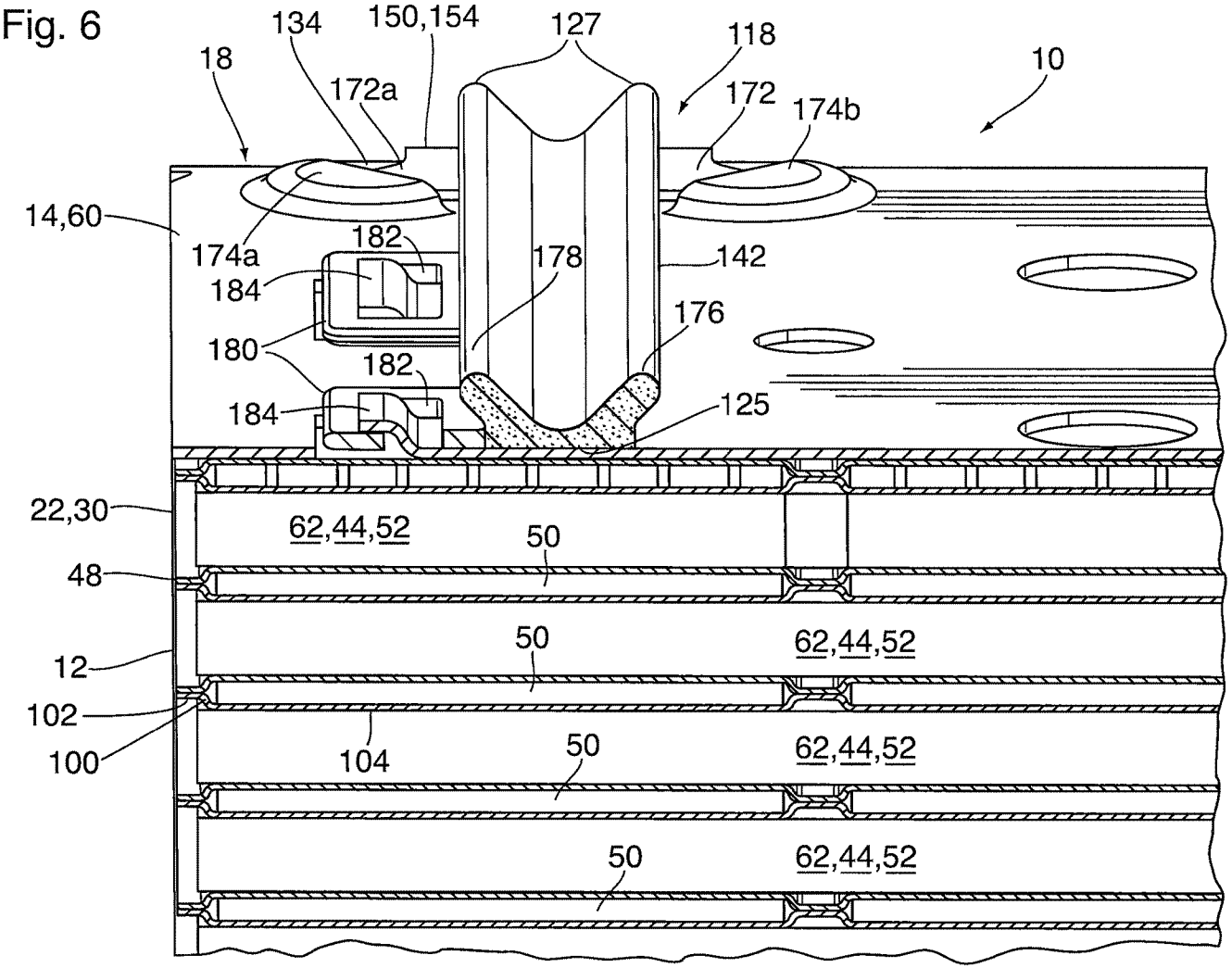
FIGS. 6 to 8 are enlarged cross-sectional views showing features of the core.

The flat tubes 48 may be of various constructions, and in the present embodiment are comprised of pairs of core plates 100, shown in FIG. 5, each of which has a planar peripheral flange 102 surrounding a raised central area 104. The flat tubes 48 are formed by joining together a pair of core plates 100 in face-to-face relationship, wherein the core plates 100 are sealingly joined together along their peripheral flanges 102, for example by brazing. In the assembled tube 48, the coolant flow passage 50 is defined between the raised central areas 104 of the joined plates 100 and is sealed around its edges by the joined peripheral flanges 102. The core plates 100 may be identical and/or mirror images of one another.

As shown, portions of the planar peripheral flanges 102 extending along the length of the core 12 define the first and second sides 26, 28 of the second fluid flow passages 50, and the first and second sides 26, 28 extend outwardly of the first and second side planes S1, S2 respectively, as further discussed below.

Figure 4:
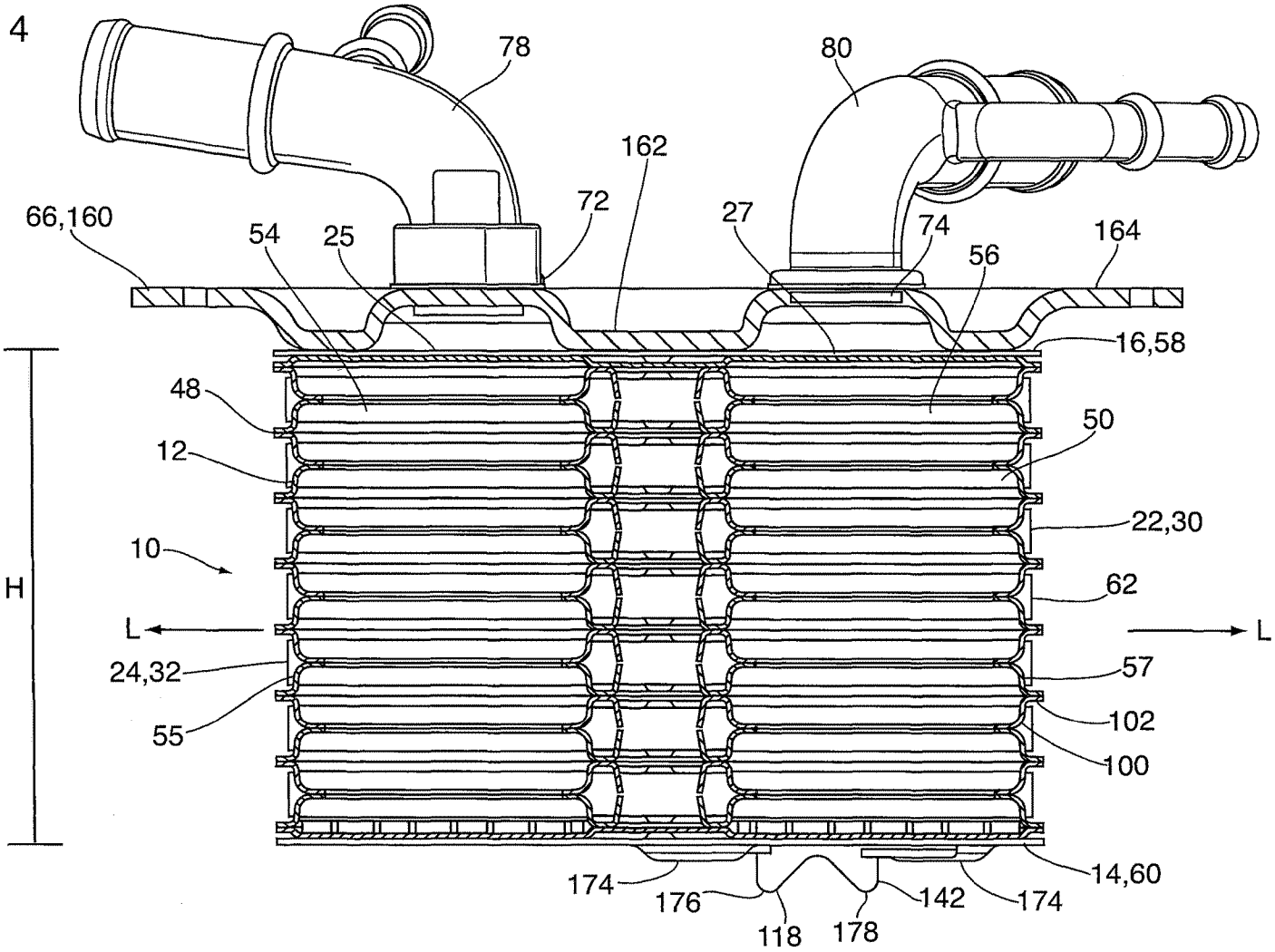
FIG. 4 is a cross-section along line 4-4' of FIG. 1.

The second fluid flow passages 50 of core 12 are connected by a pair of second fluid manifolds 54, 56, also referred to herein as coolant manifolds 54, 56. As shown in FIGS. 4 and 5, the manifolds 54, 56 are formed by providing apertured, upstanding bosses or bubbles 55, 57 in each of the plates 100 making up the tubes 48, with the bosses of adjacent plate pairs being joined to form continuous manifolds 54, 56. The manifolds 54, 56 are in communication with each of the coolant flow passages 50 and extend throughout the height of the core 12, from the top 14 to the bottom 16. The lower ends of manifolds 54, 56 are closed by a bottom plate 58 which defines the bottom 16 of core 12, while the top 14 of core 12 is defined by a top plate 60 in which the coolant openings 25, 27 are defined.

In the heat exchanger 10, the coolant manifolds 54, 56 are located adjacent to opposite ends 22, 24 of core 12, such that the second fluid flow passages 50 are U-shaped and the directions of air and coolant flow in heat exchanger 10 are substantially perpendicular to one another (cross-flow arrangement).

For reasons which will be explained below, the core 12 further comprises a plurality of inwardly extending surfaces. In this regard, the first side 18 of core 12 defines a first inwardly extending surface 134 and a second inwardly extending surface 136 which are spaced apart along the height of the core 12, wherein both the first and second inwardly extending surfaces extend inwardly of the first side plane S1 toward the second side plane S2.

Similarly, the second side 20 of core 12 defines a third inwardly extending surface 138 and a fourth inwardly extending surface 140 which are spaced apart along the height of the core 12, wherein both the third and fourth inwardly extending surfaces extend inwardly of the second side plane S2 toward the first side plane S1.

In the present embodiment the top plate 60 defines the top 14 of core 12, and the bottom plate 58 defines the bottom 16 of core 12, wherein the first and third inwardly extending surfaces 134, 138 are located on the top plate 60, and the second and fourth inwardly extending surfaces 136, 140 are located on the bottom plate 58. These surfaces are substantially transverse to the height direction of the core 12, for reasons which will become apparent below. It will be appreciated that the inwardly extending surfaces are not necessarily on the top and bottom of core 12, and that they may instead be located on other surfaces extending transversely to the height H of core 12, such as a surface of one of the flat tubes 48 making up core 12.

Heat exchanger 10 further comprises a housing 34 surrounding the core 12, the housing 34 having an inlet end portion 36 and an outlet end portion 38. The inlet end portion 36 includes a gas inlet opening 40 communicating with the first fluid inlet opening 30 of core 12, which is to be connected directly or indirectly to an upstream component of a vehicle engine system, such as an air compressor (not shown). The outlet end portion 38 includes a gas outlet opening 42 communicating with the first fluid outlet opening 32 of the core 12, which is to be directly or indirectly connected to a downstream component of a vehicle engine system, such as an intake manifold (not shown). In some embodiments, the housing 34 may comprise an intake manifold of a vehicle engine, in which case the first fluid outlet opening 32 of core 12 may communicate directly with the vehicle engine (not shown). In the following description, it will be understood that references to the housing 34 will include embodiments where the housing is an intake manifold.

For ease of assembly, the housing 34 typically comprises two or more separately formed segments, for example as described in above-mentioned International Publication No.

WO 2015/164968 A1. However, the specific construction of the housing 34 is not necessary to an understanding of the present invention, and therefore these details are omitted from the present discussion and from the drawings.

The housing 34 comprises a top wall 64 and an opposed bottom wall 66, and a first side wall 68 and an opposed second side wall 70. The side walls 68, 70 extend between the top wall 64 and the bottom wall 66. The first and second side walls 68, 70 extend along, and are spaced from, the respective first and second sides 18, 20 of the core 12, and from the respective first and second side planes S1, S2. Similarly, the top wall 64 of housing 34 extends along and is spaced from the top 14 of core 12. Together with the end portions 36, 38, the walls 64, 66, 68, 70 of housing 34 form a substantially continuous enclosure about the core 12, except at inlet and outlet openings for the gas and coolant.

In the present embodiment, the bottom wall 66 of housing 34 may be separate from the remainder of housing 34, such that the core 12 may be dropped into the housing 34, and the bottom wall 66 is then sealed to the remainder of housing 34. Optionally, in the present embodiment, the bottom wall 66 is integrated with the core 12, comprising a relatively thick, flat flange plate 160 which may be comprised of aluminum. The flange plate 160 has a relatively flat central portion 162 surrounded by an upstanding peripheral flange 164, wherein the central portion 162 of flange plate 160 is secured to the bottom plate 58 of the core 12, for example by brazing, and the upstanding flange 164 is spaced therefrom in the height dimension of core 12.

The flange plate 160 is provided with a pair of coolant openings 72, 74 and a pair of coolant fittings 78, 80 which communicate with the coolant manifolds 54, 56 and second fluid flow passages 50. The upstanding peripheral flange 164 of the flange plate 160 projects outwardly of the core 12 and is adapted to be sealingly connected to the remainder of housing 34 by any convenient means, such as mechanical connection, brazing or welding. For example, as shown in the drawings, the upstanding peripheral flange 164 may be provided with apertures which are adapted to receive mechanical fasteners 165 such as nuts, bolts and/or screws.

In the present embodiment, the first and second sides 18, 20 of core 12 are spaced from the respective first and second side walls 68, 70 of housing 34, and the top 14 of core 12 is spaced from the top wall 64 of housing 34. In this particular embodiment, the bottom 16 of core 12 is in direct contact with the central portion 162 of flange plate 160, wherein the flange plate 160 defines the bottom wall 66 of housing 34.

The corrugated fins 62 provide the core 12 with a certain amount of resistance to gas flow, and therefore the gas to be cooled will tend to bypass the corrugated fins 62 and flow through any spaces located outside the sides 18, 20 of core 12, including any spaces between the housing 34 and the core 12 which permit free flow between the gas inlet opening 40 and the gas outlet opening 42 of housing 34.

Heat exchanger 10 further comprises a bypass seal 118 comprising at least a first side seal portion 120 and a second side seal portion 122. In the present embodiment, the bypass seal 118 also comprises a top seal portion 142.

The first side seal portion 120 is received between the first side 18 of core 12 and the first side wall 68 of the housing 34, wherein the first side seal portion 120 has an inner surface 124 engaging the first side 18 of core 12 and an outer surface 126 engaging the first side wall 68 of housing 34. The second side seal portion 122 is received between the second side 20 of core 12 and the second side wall 70 of the housing 34, wherein the second side seal portion 122 has an inner surface 124 engaging the second side 20 of core 12 and an outer surface 126 engaging the second side wall 70 of housing 34. The first and second side seal portions 120, 122 extend throughout the height H of core 12.

The top seal portion 142 is received between the top 14 of core 12 and the top wall 64 of housing 34, wherein the top seal portion 142 has an inner surface 125 engaging the top 14 of core 12 and an outer surface 127 engaging the top wall 64 of housing 34, with at least the outer surface 127 being resilient.

The bypass seal 118 may be continuous, with the elongate top seal portion 142 having one end connected to the first side seal portion 120 and another end which is connected to the second side seal portion 122, such that the bypass seal has a C-shape. In some embodiments the side seal portions 120, 122 may be integrally formed with the top seal portion 142.

The cross-sectional shape of the bypass seal 118 is variable. For example, each of the side seal portions 120, 122 and the top seal portion 142 may have a simple cross-sectional shape such as square, rectangular, circular, oval, etc.

In the present embodiment, each of the side seal portions 120, 122 and the top seal portion 142 has a generally U-shaped or V-shaped cross-section, as further discussed below.

The inner surfaces 124 of first and second side seal portions 120, 122 are adapted to seal with the sides 18, 20 of core 12. In the present embodiment the first and second sides 26, 28 of the second fluid flow passages 50 extend outwardly of the respective first and second side planes S1, S2 toward the first and second side walls 68, 70 of housing 34, and therefore the sides 18, 20 of the core 12 have an irregular shape. In order to seal with the sides 18, 20 of the core 12, the inner surfaces 124 of the first and second side seal portions 120, 122 have a comb-like shape, including a plurality of alternating projections 82 and recesses 84 to receive the sides 26, 28 of the second fluid flow passages 50.

The inner surface 125 of top seal 142 is adapted to seal with the top plate 60, which is substantially flat and planar. Therefore, the inner surface 125 of top seal portion 142 may also be substantially flat and planar.

The outer surfaces 126 of the side seal portions 120, 122 are adapted to seal with the side walls 68, 70 of housing 34, and the outer surface 127 of top seal portion 142 is adapted to seal with the top wall 64 of the housing 34. The walls 64, 68, and 70 are flat and planar. In the illustrated embodiment, the outer surfaces 126, 127 of the bypass seal 118 are shown as having a V-shape which is defined by a pair of spaced apart lobes 176, 178 adapted to sealingly engage the walls 64, 68, 70 of the housing 34. However, it is not necessary that the outer surface 126, 127 have this shape. Instead, the outer surfaces 126, 127 may have any suitable shape, including flat or rounded.

The provision of two or more lobes 176, 178 for sealing provides benefits in that the lobes 176, 178 provide multiple points of contact with the housing 34, with each lobe 176, 178 forming a seal with the housing 34. This arrangement provides a labyrinth seal, whereby any gas flowing through a small space between the housing 34 and one of the lobes 176, 178 will become reduced in energy in this space. Such an arrangement is described in commonly assigned US Publication No. US 2016/0097596 A1. Alternatively, or in addition to this arrangement, a labyrinth seal may be provided by providing two or more bypass seals 118 spaced apart along the axis L.

The bypass seal 118 may be at least partially formed from a resilient material such as a foamed polymer. Where the bypass seal 118 is resilient, it will have a thickness sufficient that it will undergo some compression when received between core 12 and housing 34. For example, the bypass seal 118 may have an uncompressed thickness which is greater than the width of the second gap 112.

Heat exchanger 10 and bypass seal 118 include retention features which will prevent displacement of the bypass seal 118 from its desired position by the force of the charge air.

Firstly, bypass seal 118 includes retention features to prevent displacement of the top seal portion 142. In this regard, the top seal portion 142 may be provided with one or more slotted tabs 180 projecting from, and co-planar with, the inner surface 125 the top seal portion 142. In the present embodiment, a plurality of such slotted tabs 180 are provided, each projecting axially in the upstream direction toward the first end 22 of the core 12, at which the first fluid inlet 30 is located.

The top 14 of the core 12 is provided with one or more projections 184, each of which is adapted to be received in the slot 182 of one of the slotted tabs 180 of the bypass seal. These projections 184 are formed in the top plate 60, for example by cutting or punching the top plate 60 to form the raised projections 184. As can be seen from FIG. 6, each projection 184 may include an end portion projecting toward the first end 22 of the core 12 at which the first fluid inlet 30 is located. This provides an interlocking engagement between the projection 184 and tab 180, and reduces the risk that the top seal portion 142 will become detached from the top 14 of core 12 by the force of charge air flowing toward the top seal portion 142 from the first end 22 of core 12.

Secondly, bypass seal 118 includes retention features to prevent displacement of the first and second side seal portions 120, 122. These retention features are in the form of first and second clip members 150 which are identical to one another in the present embodiment and are therefore identified by the same numeral.

Each of the clip members 150 has a middle portion 152, a first end portion 154 and an opposed second end portion 156. In the assembled heat exchanger 10, the middle portion 152 of each clip member 150 is received between the first or second side 18, 20 of the core 12 and the first or second side wall 68, 70 of the housing 34, and extends along the height direction of the core 12. The first side seal portion 120 is connected to the middle portion 152 of the first clip member 150 and the second side seal portion 122 is connected to the middle portion 152 of the second clip member 150.

The first end portion 154 of the first clip member 150 extends inwardly from the top end of middle portion 152 and extends inwardly of the first side plane S1 of core 12, engaging the first inwardly extending surface 134 of core 12. The second end portion 156 of the first clip member 150 extends inwardly from the bottom end of middle portion 152 and extends inwardly of the first side plane S1 of core 12, engaging the second inwardly extending surface 134 of core 12.

Similarly, the first end portion 154 of the second clip member 150 extends inwardly from the top end of middle portion 152 and extends inwardly of the second side plane S2 of core 12, engaging the third inwardly extending surface 138. The second end portion 156 of the second clip member 150 extends inwardly from the bottom end of middle portion 152 and extends inwardly of the second side plane S2 of core 12, engaging the fourth inwardly extending surface 140.

The clip members 150 may be somewhat resilient, for example to permit the first and second end portions 154, 156 to be spread apart by a small amount to permit the clip members 150 to grip the inwardly extending surfaces 134, 136, 138, 140 and be retained on the core during assembly of heat exchanger 10. For this reason, the distance between the first and second end portions 154, 156 of clip members 150, prior to installation on core 12, may be slightly less than the distance between the first and second inwardly extending surfaces 134, 136 and slightly less than the distance between the third and fourth inwardly extending surfaces 138, 140.

Figure 13:
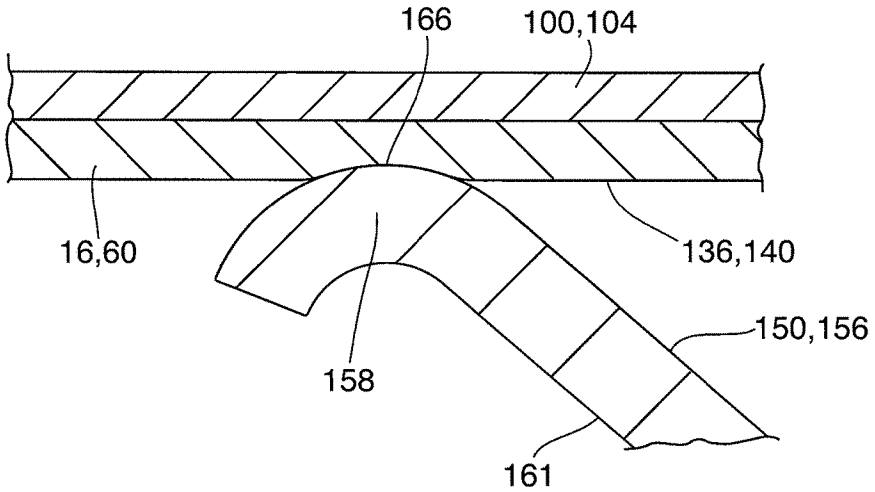
FIG. 13 is a close-up cross-sectional view illustrating a feature for improving retention of the clip member on the core.
Figure 14:
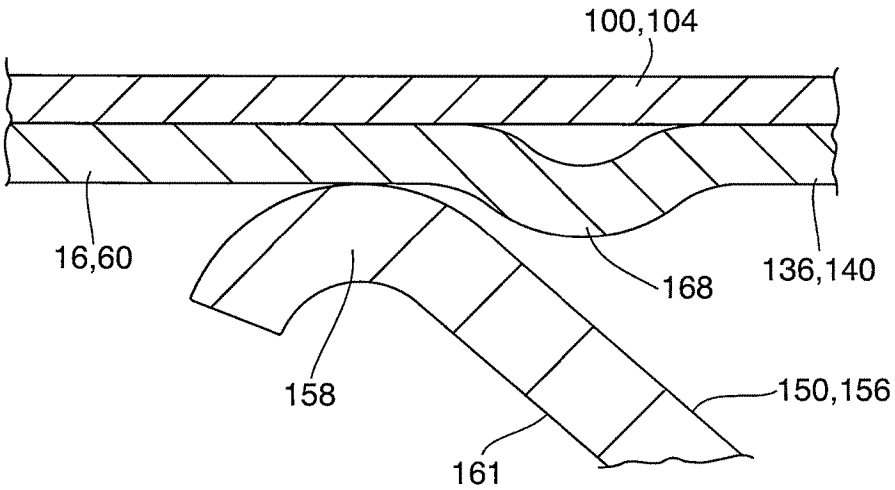
FIG. 14 is a close-up cross-sectional view illustrating an alternate feature for improving retention of the clip member on the core.

One or both of the end portions 154, 156 of the clip members 150 may be adapted for spring-like resilience. For example, in the illustrated embodiment, the second end portions 156 of the clip members 150 comprise a contact portion 158 and an arcuate portion 161 connected thereto. With the clip member 150 installed on the core, the arcuate portion 161 is spaced from the core 12 and provides a flexible, resilient connection between the contact portion 158 and the middle portion 152 of the clip member 150. To improve retention of the contact portion 158, the second or fourth inwardly extending surface 136, 140 may be provided with a shallow depression 166, as shown in FIG. 13, in which the contact portion 158 is retained. Alternatively, the second or fourth inwardly extending surface 136, 140 may be provided with a local projection 168, such as a dimple as shown in FIG. 14, protruding therefrom along the height H of the core 12, wherein the projection 168 is located laterally between the contact portion 158 and the middle portion 152 of the clip member 150.

The clip members 150 may be comprised of metal or plastic. In some embodiments, each of the core 12 and the clip members 150 is comprised of a brazeable metal, such as an alloy of aluminum or stainless steel, such that the first and second end portions 154, 156 of the first clip member 150 can be brazed to the respective first and second inwardly extending surfaces 134, 136 of core 12, and the first and second end portions 154, 156 of the second clip member 150 can be brazed to the respective third and fourth inwardly extending surfaces 138, 140 of core 12. In this case, the metal clip members 150 are clipped to the assembled, pre-brazed core 12, and the core 12 together with the clip members 150 is brazed in a brazing furnace. In cases where the first and second side seal portions 120, 122 are comprised of a resilient, foamed polymeric material, they are connected to the middle portions 152 of the clip members 150 after the furnace brazing operation.

Figure 7:
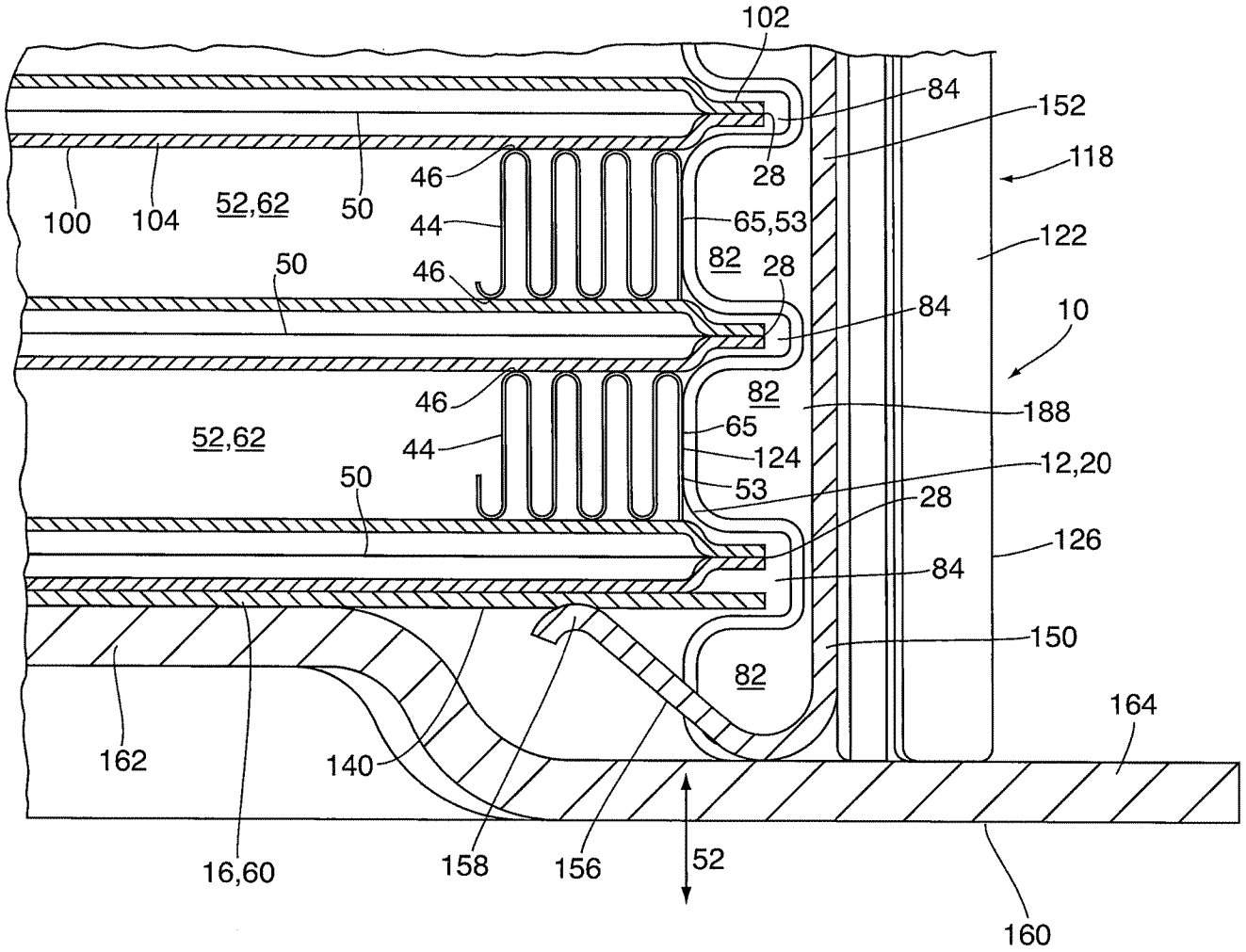
Figure 8:
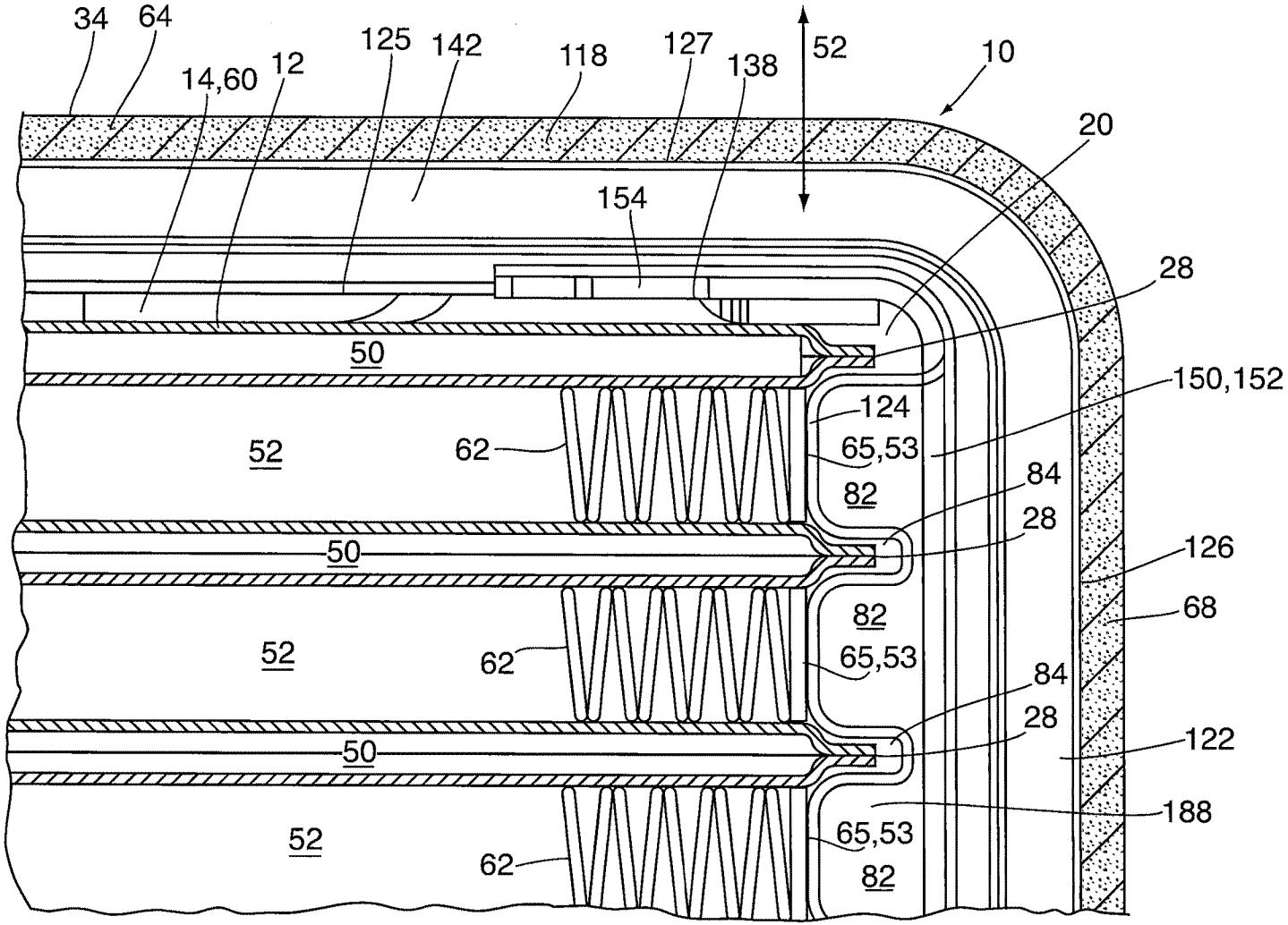
Figure 9:
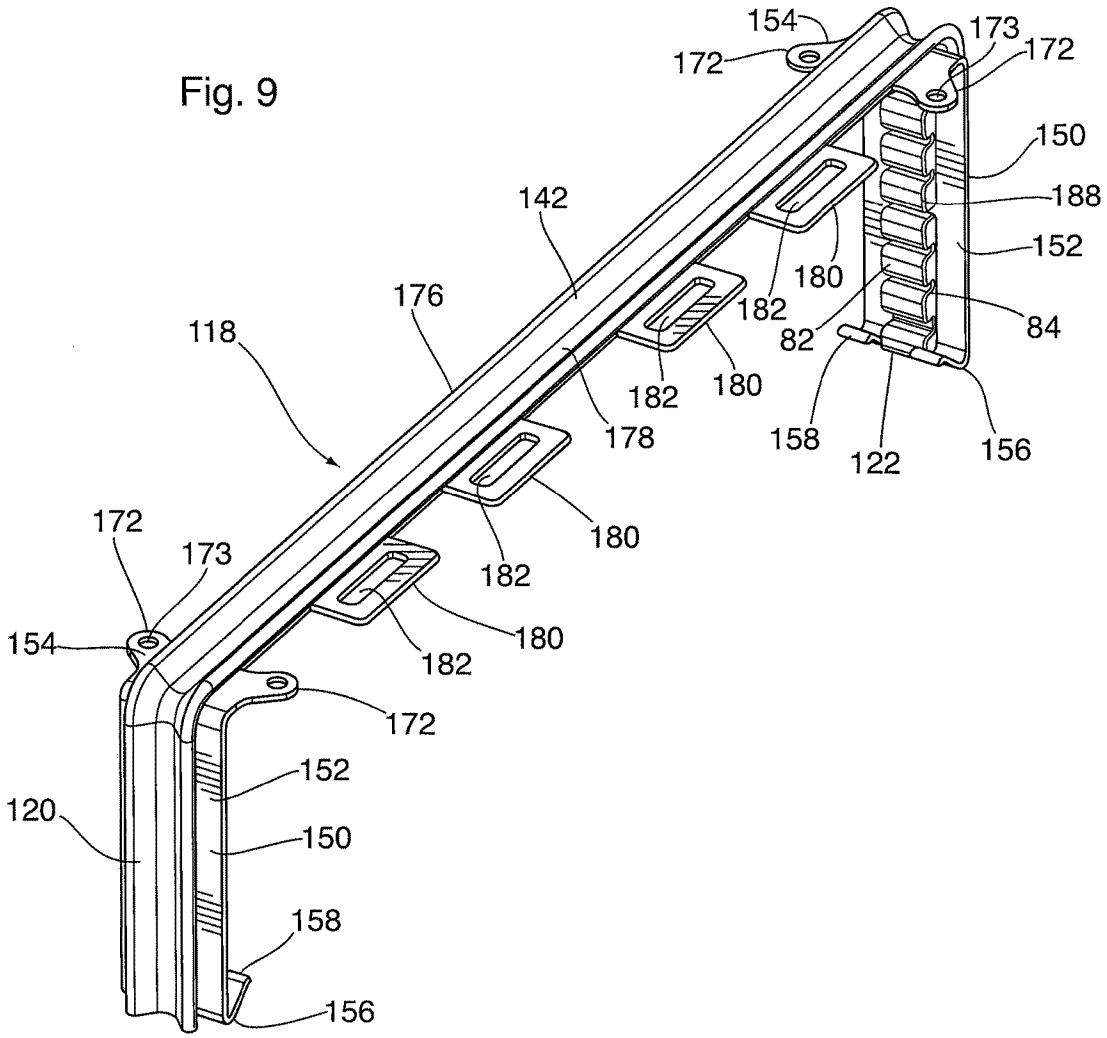
FIGS. 9 and 10 are enlarged views of the bypass seal and clip members.
Figure 10:
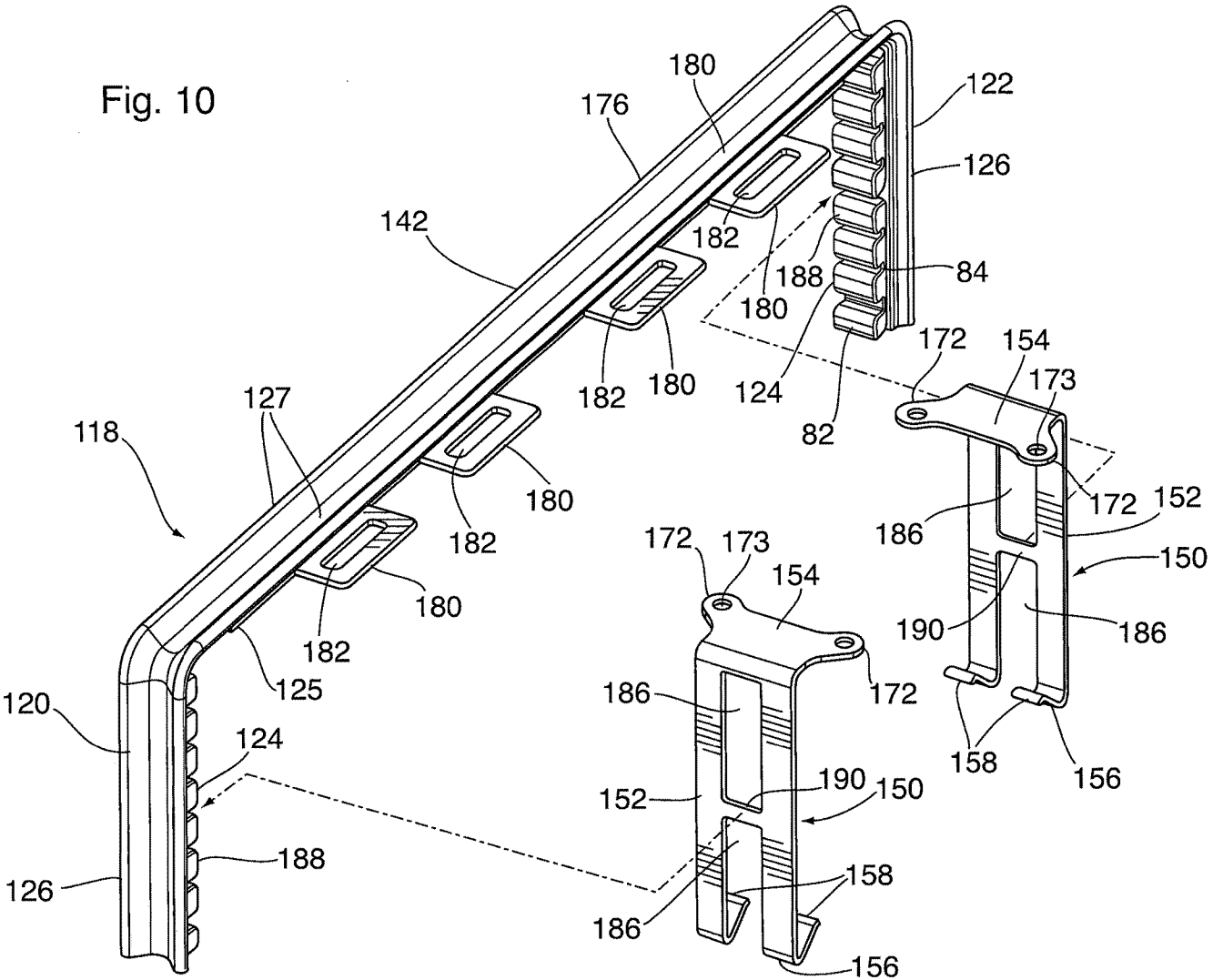

In the illustrated embodiment, the upstanding peripheral flange 164 is spaced away from the core 12, and more specifically from the edges of the bottom plate 58 along which the second and fourth inwardly extending surfaces 136, 140 are defined. In other words, the central portion 162 of flange plate 160 does not extend outwardly to the edges of bottom plate 58, at least along the first and second sides 18, 20 of the core 12, but rather the central portion 162 is spaced inwardly therefrom, and is also spaced inwardly from the side planes S1, S2. The areas of the bottom plate 58 between sides 18, 20 and the central portion 162 define the respective second and fourth inwardly extending surfaces 136, 140. The spacing between the upstanding peripheral flange 164 and the second and fourth inwardly extending surfaces 136, 140 is sufficient to receive the second end portion 156 of one of the clip members 150, and FIG. 7 shows the second end portion 156 of one of the clip members 150 received between one of the second and fourth inwardly extending surfaces 136, 140 and the upstanding peripheral flange 164 of the flange plate 160.

The first end portions 154 of the first and second clip members 150 extend inwardly from the top end of middle portion 152 and engage the respective first and third inwardly extending surfaces 134, 138 of core 12. In the illustrated embodiment, the first end portion 154 of each clip member 150 is substantially flat and planar, and extends inwardly from the middle portion 152 at an angle of about 90 degrees, such that it will lie substantially flat against one of the first and third inwardly extending surfaces 134, 138 defined along the top plate 60 of core 12.

To retain the first end portion 154 of each clip member 150 in its desired location, each of the first and third inwardly extending surfaces 134, 138 along the top plate 60 may be provided with one or more slots 170, each of which is adapted to receive a tip portion 172 of one of the clip members 150, wherein each tip portion 172 is formed at the free end of the first end portion 154, distal to the middle portion 152 of the clip member 150.

In the illustrated embodiment, each of the slots 170 is formed in a slightly raised, flat bubble 174 formed in the top plate 60, the bubble 174 defining an inner cavity with a height slightly greater than the thickness of the tip portion 172. Each of the slots 170 is formed in an edge of a bubble 174, and each slot 170 generally faces toward one of the side planes S1, S2. In the illustrated embodiment, the slots 170 are angled diagonally relative to the axis, and to the sides 18, 20 and side planes S1, S2.

In embodiments where heat exchanger 10 is provided with a top seal 142 axially aligned with the first and second side seals 120, 122, it is desirable to locate the bubbles 174 in areas of the top plate 60 where they will not interfere with placement of the top seal 142 along top plate 60. Therefore, as shown in the illustrated embodiment, the bubbles 174 and the slots 170 formed therein are axially displaced away from the top seal 142. The bubbles 174 and slots 170 are therefore also axially displaced from the side seal portions 120, 122 and the middle portions 152 of clip members 150. In order to engage the slots 170 in the axially displaced bubbles 174, the tip portions 172 are also axially displaced along the top plate 60, relative to the middle portion 152 of each clip member 150.

Although only one bubble 174 and one slot 170 is required for each of the first end portions 154, the present embodiment includes a pair of axially displaced bubbles 174 with slots 170 in each of the first and third inwardly extending surfaces 134, 138, one such bubble 174*a* and slot 170*a* being located upstream of the bypass seal 118 and the other bubble 174*b* and slot 170*b* being located downstream of the bypass seal 118.

Similarly, each clip member 150 has a pair of tip portions 172*a*, 172*b*, each of which extends axially outwardly from the first end portion 154, such that the first end portion 154 is Y-shaped. The tip portions 172*a*, 172*b* are adapted to extend through the respective slots 170*a*, 170*b* into the bubbles 174*a*, 174*b*. Because each of the tip portions 172*a*, 172*b* branches out from the first end portion 154 at an angle, the slots 170*a*, 170*b* are angled diagonally toward one another so as to receive the tip portions 172*a*, 172*b*.

Where the clip members 150 are brazed to the core 12, the first end portion 154 will be brazed to the top plate 60, with the tip portions 172*a*, 172*b* being brazed inside the slots 170*a*, 170*b*. Furthermore, it may be desired to provide a mechanical connection between the first end portions 154 of clip members 150 and the top plate 60. A mechanical connection may be used, for example, where the bypass seal 118 is applied to the core 12 after brazing, or where it is desired to connect the clip members 150 to the top plate 60 through both a brazed connection and a mechanical connection.

Figure 16:
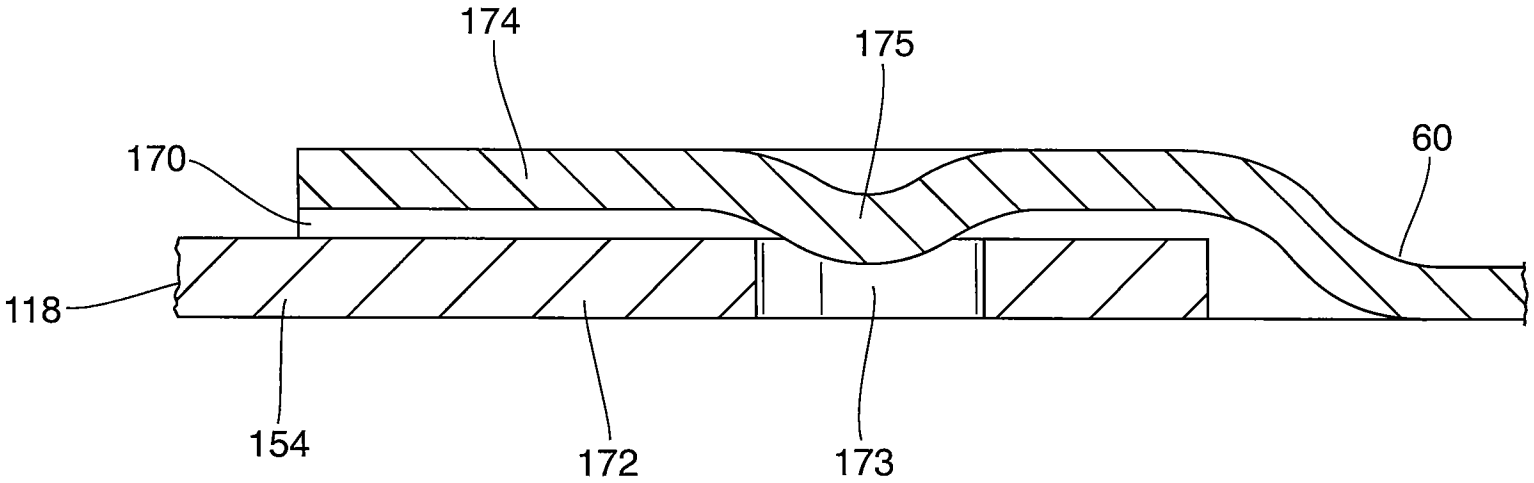
FIG. 16 is a cross-section along line 16-16' of FIG. 2.

As shown in the drawings, each of the tip portions 172 of clip members 150 has an aperture 173, wherein the aperture 173 is located within flat bubble 174 when the tip portions 172 are inserted into slots 170. a mechanical connection can be formed by simply punching the top surface of flat bubble 174 immediately above the aperture 173. The punch creates a discontinuity such as a dimple 175 which extends into the aperture 173 and therefore prevents withdrawal of the tip portion 172 from slot 170. FIG. 16 illustrates this feature.

Although the first and second end portions 154, 156 are shown as having specific configurations which are different from one another, it will be appreciated that this is not necessarily the case. For example, both the first and second end portions 154, 156 may have the same configuration, which may be the same as or different from the configurations of end portions 154, 156 described above.

As mentioned above, the first and second side seal members 120, 122 are connected to the middle portions 152 of the first and second clip members 150, so as to retain the first and second side seal members 120, 122 and the bypass seal 118 in its desired position during use, against the force of the incoming charge air.

In the embodiment illustrated in FIGS. 1 to 10, resilient clip members 150 are formed of metal or plastic. In cases where both the core 12 and clip members 150 comprise a brazeable metal such as aluminum alloys or stainless steel, they may be brazed together. In this embodiment, the side seal portions 120, 122 and the top seal portion 142 are comprised at least partially of a resilient, foamed polymeric material. For example, in an embodiment, the side seal portions 120, 122 may be entirely formed of a resilient, foamed polymeric material, whereas all portions of the top seal portion 142 except the tabs 180 are comprised of a resilient, foamed polymeric material, and may be integrally formed with the side seal portions 120, 122, whereas the tabs 180 may be comprised of a relatively rigid polymeric material.

In this embodiment, the middle portion 152 of each clip member 150 is provided with one or more apertures 186, and each of the side seal portions 120, 122 includes a mating or male portion 188 which is adapted to be closely received in one of the apertures 186 and be retained therein. In the illustrated embodiment, each clip member 150 has two apertures 186 in the form of slots which are separated by a web 190. The projections 82 along the comb-like inner surfaces 124 of the first and second side seal portions 120, 122 are adapted to be closely received in the apertures 186 and to protrude therethrough, while the web 190 is adapted to be received in one of the recesses 84 of the side seal portions 120, 122. It will be appreciated that variations can be made to this arrangement without departing from the scope of this description.

Figure 11:
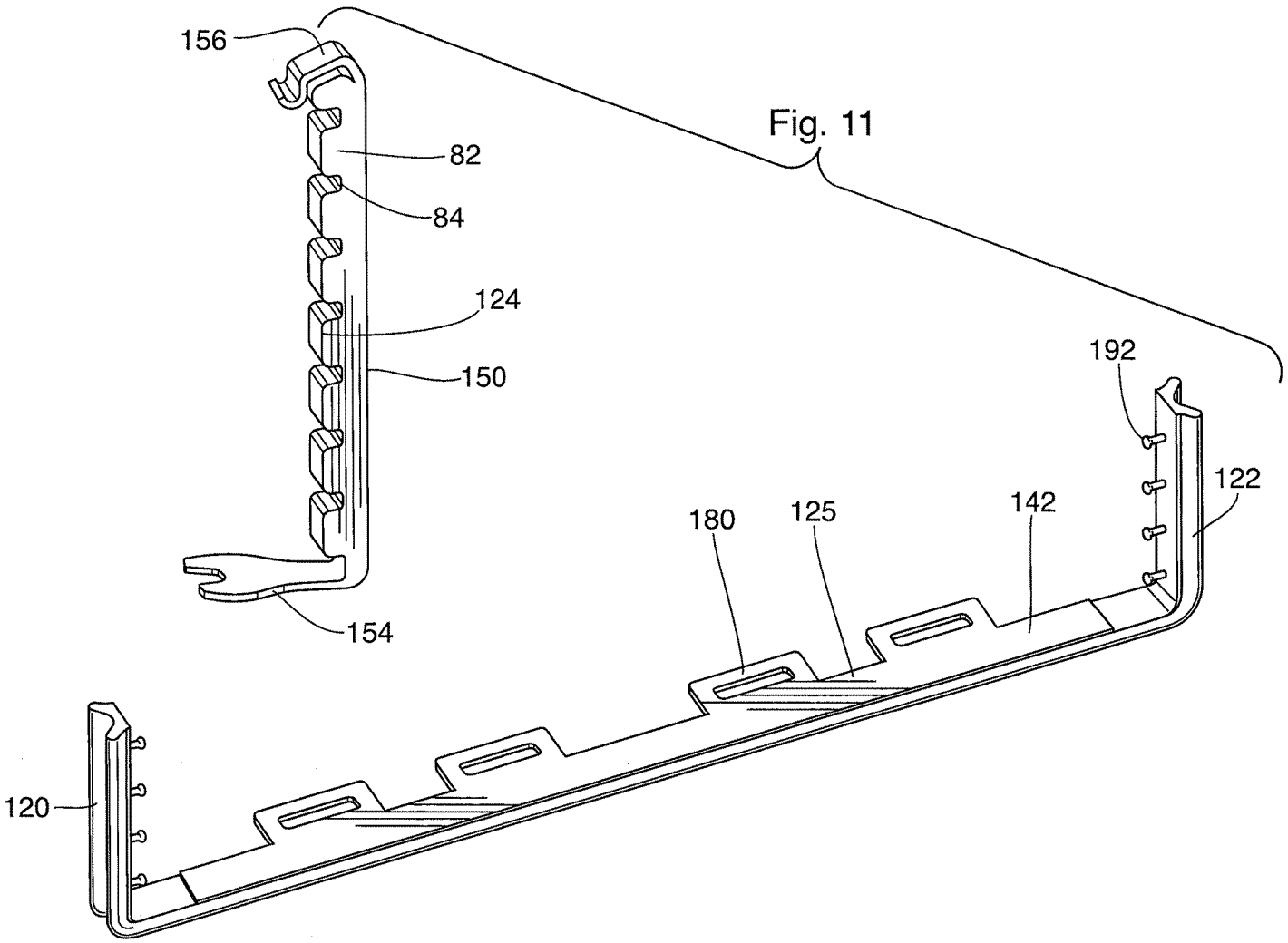
FIG. 11 shows a bypass seal according to a second embodiment.

For example, in another arrangement shown in FIG. 11, the portions of the first and second side seal portions 120, 122 defining the projections 82 and recesses 84 may be permanently attached to and/or integrally formed with the first and second clip members 150. In such an arrangement, the projections 82 may be formed of a resilient, foamed polymeric material while the clip member is metal or plastic or, alternatively, where the clip members 150 and projections 82 are integrally formed, the clip members 150 and projections 82 may comprise the same rigid polymeric material. In this arrangement, the outer portions of the side seal members 120, 122 may be attached to the combined clip 150 with projections 82, for example by connecting elements such as snap fit pins 192 which are adapted to be received in corresponding holes in the outer surface of the clip 150. Other connecting elements include adhesive. As shown in the drawings, the outer portions of the side seal portions 120, 122 may be connected to the top seal portion 142, and may be integrally formed therewith.

Figure 12:
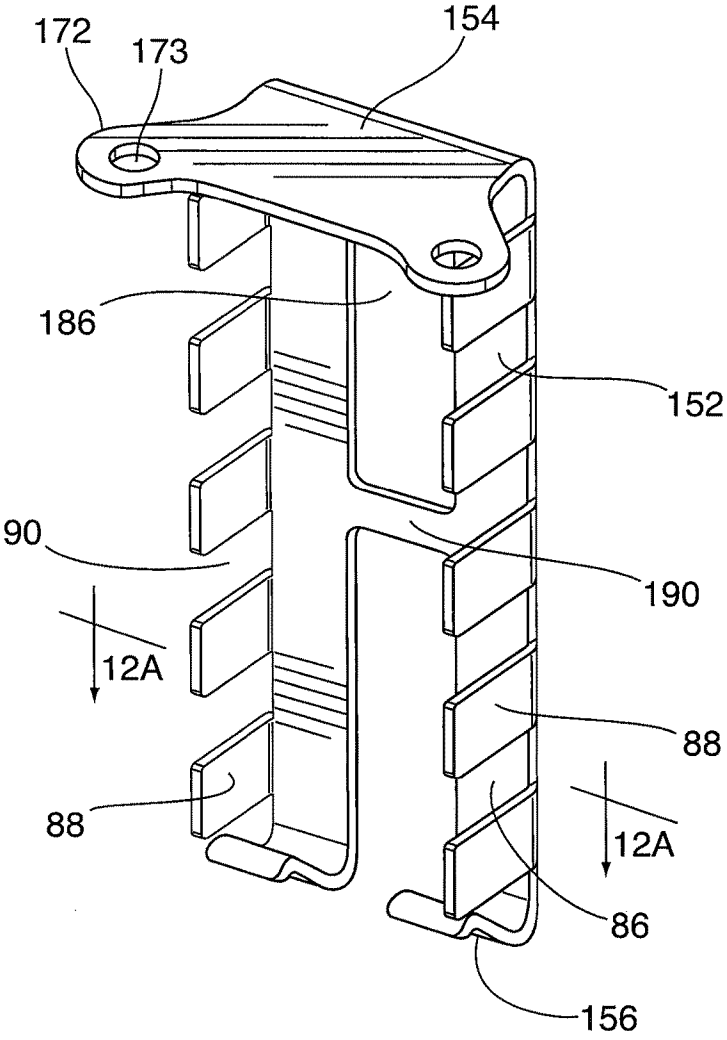
FIG. 12 shows a bypass seal according to third embodiment.
Figure 12A:
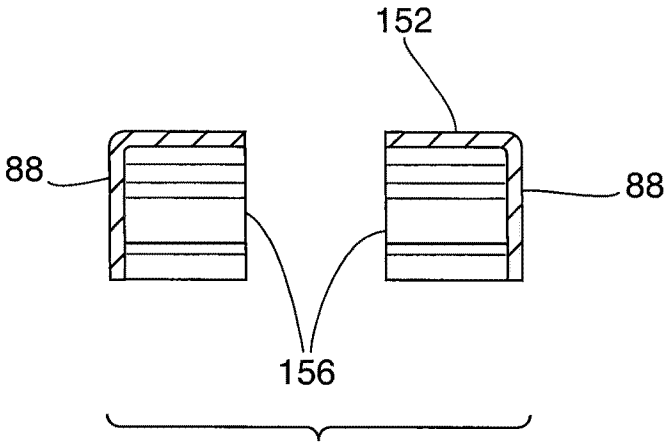
FIG. 12A is a cross-section along line 12A-12A of FIG. 12.

In another embodiment, the clip members 150 and the first and second side seal portions 120, 122 may be integrally formed with one another, and may be formed from metal or plastic. For example, FIGS. 12 and 12A show a combined clip/side seal portion 86 which includes a middle portion 152, a first end portion 154 and a second end portion 156 as described above, and which includes a plurality of bypass blocking tabs 88 extending inwardly from the middle portion 152 and spaced apart along the middle portion 152 to form recesses 90. It can be seen that these bypass blocking tabs 88 and recesses 90 form a comb-like shape in order to receive the sides 26, 28 of the second fluid flow passages 50, as with the alternating projections 82 and recesses 84 of side seal portions 120, 122 described above.

It can be seen that the modified clip member 86 can be simply formed from either plastic or metal. For example, it may be stamped as a single piece from a sheet of metal and bent to the shape shown in the drawings.

Figure 15:
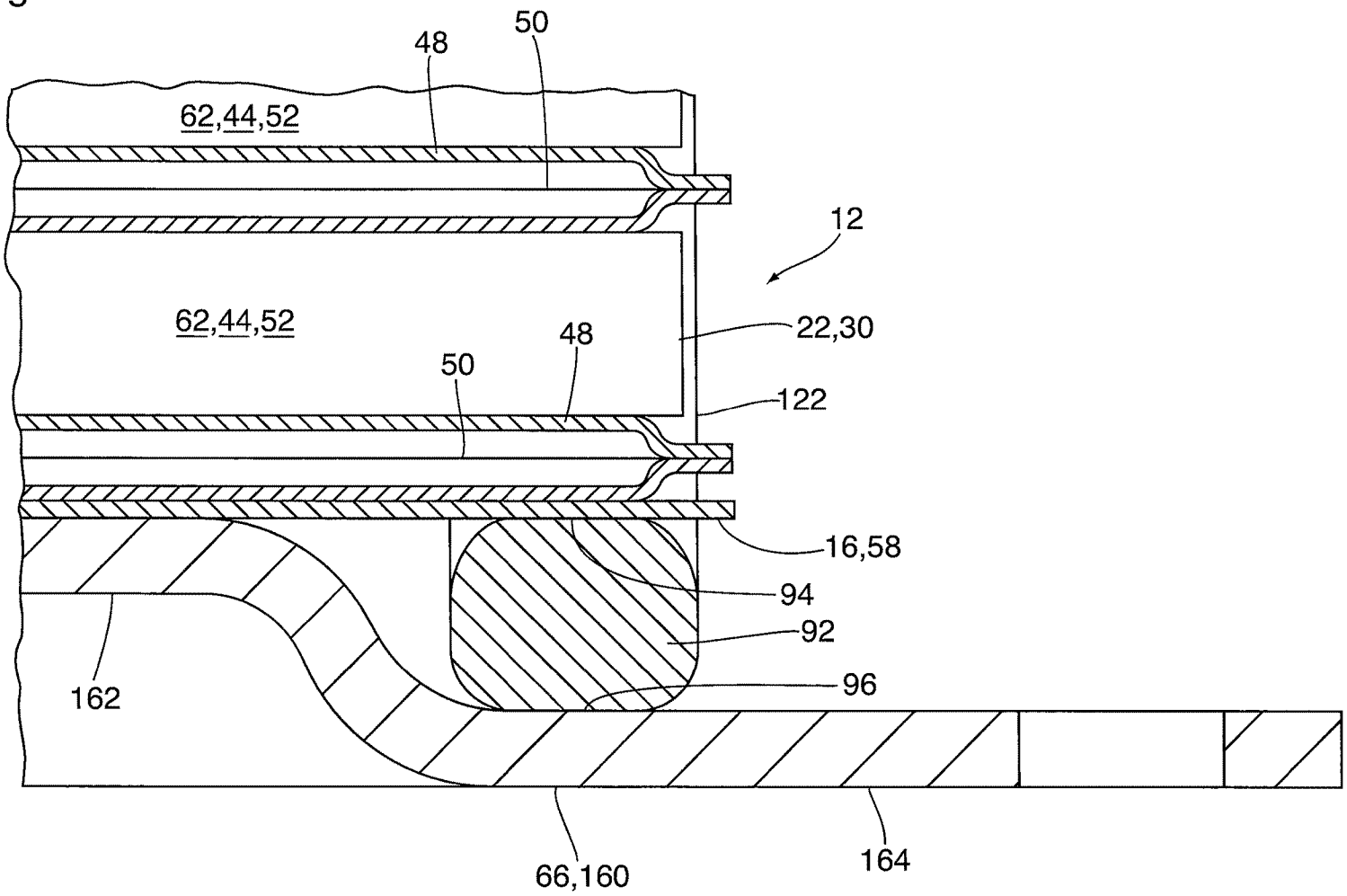
FIG. 15 is a close-up cross-sectional view illustrating a heat exchanger core including a resilient bottom seal portion.

In addition to the side seal portions 120, 122 and the top seal portion 142, the bypass seal 118 may further comprise a resilient bottom seal portion 92 as shown in FIG. 15. The bottom seal portion 92 is received between the upstanding peripheral flange 164 of the flange plate 160 and the bottom plate 58 of the core 12, wherein the bottom seal portion 92 has an inner surface 94 adapted to engage the bottom plate 58 and an outer surface 96 adapted to engage the upstanding peripheral flange 164. In some embodiments, the resilient bottom seal portion 92 has one end which is connected to the first side seal portion 120 and an opposite end which is connected to the second side seal portion 122 so as to form a continuous, unbroken seal and reduce the risk that there will be small gaps at the bottom ends of the side seal portions 120, 122. The bottom seal portion 92 may have any desired profile, which may be the same or different from that of the side seal portions 120, 122 and/or the top seal portion 142. For example, as shown in FIG. 15, the bottom seal portion 92 may have a simple rectangular or rounded profile.

It can be seen that the inclusion of bottom seal portion 92 permits the creation of a continuous, four-sided seal around the core 12. However, due to the positioning of the bottom seal portion 92 at or close to the first end 22 of core 12, it would be necessary to modify some of the above-described retention features of the side seal portions 120, 122 and the top seal portion 142. For example, rather than placing the slotted tabs 180 and the projections 184 on the upstream side of the top seal portion 142, they may instead be placed on the downstream side of top seal portion. Also, the upstream tip portion 172*a* of each clip member 150 and the upstream bubble 174*a* of top plate 60 would be eliminated.

Figure 17:
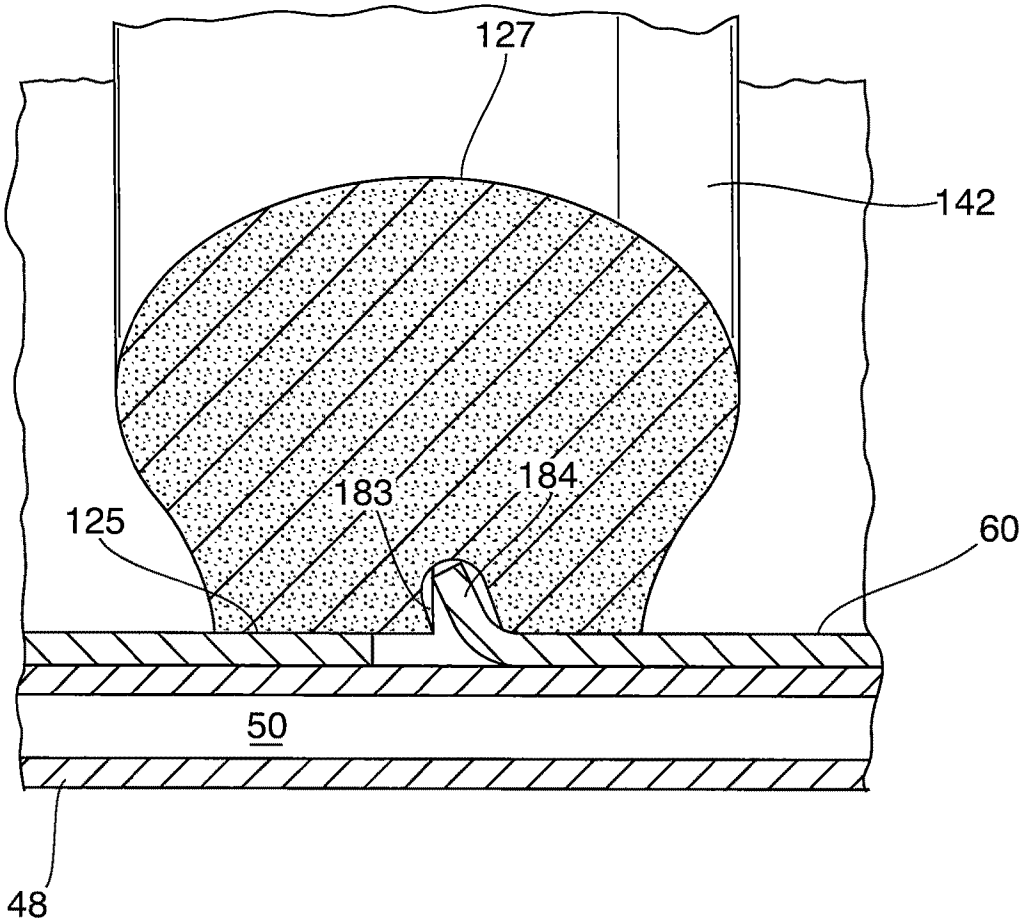
FIG. 17 is a cross-section showing an alternate configuration of the top seal.

The drawings show a specific arrangement by which the top seal 142 is retained in relation to the top plate 60. However, it will be appreciated that numerous other means exist for securing the top seal 142 to top plate 60. For example, as shown in FIG. 17, the top plate 60 may be provided with one or more upwardly extending projections 184 as described above. These projections 184 may be formed by cutting or punching the top plate 60 to form the raised projections 184. As can be seen from FIG. 6, each projection 184 may include an end portion projecting toward the first end 22 of the core 12 at which the first fluid inlet 30 is located. In the embodiment of FIG. 17, the projections 184 engage apertures 183 which are formed in the inner surface 125 of the top seal 142. Therefore, in the embodiment of FIG. 17, top seal 142 does not require the tabs 180 with slots 182 described in the above embodiments. In addition, FIG. 17 shows an alternative shape for the top seal 142, in which the top seal 142 has a smoothly rounded shape instead of the V-shaped configuration shown in the other drawings.

Although the invention has been described in connection with certain embodiments, it is not limited thereto. Rather, the invention includes all embodiments which may fall within the scope of the following claims.

What is claimed is:

1. A heat exchanger comprising:

(a) a core comprising:

a plurality of first fluid flow passages for flow of a first fluid and a plurality of second fluid flow passages for flow of a second fluid, the first and second fluid flow passages arranged in alternating order along a height of the core;

a top and an opposed bottom, and a first side and an opposed second side, the first and second sides each extending between the top and the bottom along the height of the core, wherein the top, the bottom and the sides extend at least generally along an axis defined by a flow direction of the first fluid;

a first end and an opposed second end spaced apart along the axis;

a first fluid inlet and a first fluid outlet, each of the first fluid inlet and the first fluid outlet being located in one of the first and second ends of the core, and facing the axis;

each of the first fluid flow passages having opposed first and second sides which are closed, wherein a first side plane passes through at least some of the first sides of the first fluid flow passages, and a second side plane passes through at least some of the second sides of the first fluid flow passages;

wherein the first side of the core defines a first inwardly extending surface and a second inwardly extending surface which are spaced apart along the height of the core, and both the first and second inwardly extending surfaces extend inwardly of the first side plane toward the second side plane;

wherein the second side of the core defines a third inwardly extending surface and a fourth inwardly extending surface which are spaced apart along the height of the core, and both the third and fourth inwardly extending surfaces extend inwardly of the second side plane toward the first side plane;

(b) a housing comprising a top wall and an opposed bottom wall, and a first side wall and an opposed second side wall, wherein the side walls extend between the top wall and the bottom wall;

wherein the first side wall of the housing is spaced from the first side of the core and from the first side plane, and the second side wall of the housing is spaced from the second side of the core and from the second side plane;

(c) a bypass seal comprising:

(i) a first side seal portion received between the first side of the core and the first side wall of the housing, wherein the first side seal portion has an inner surface engaging the first side of the core and an outer surface engaging the first side wall of the housing;

(ii) a first clip member having a middle portion, a first end portion and an opposed second end portion, the middle portion received between the first side of the core and the first side wall of the housing, the first end portion extending inwardly of the first side plane of the core and engaging the first inwardly extending surface, and the second end portion extending inwardly of the first side plane of the core and engaging the second inwardly extending surface, wherein the first side seal portion is connected to the middle portion of the first clip member;

(iii) a second side seal portion received between the second side of the core and the second side wall of the housing, wherein the second side seal portion has an inner surface engaging the second side of the core and an outer surface engaging the second side wall of the housing; and (iv) a second clip member having a middle portion, a first end portion and an opposed second end portion, the middle portion received between the second side of the core and the second side wall of the housing, the first end portion extending inwardly of the second side plane of the core and engaging the third inwardly extending surface, and the second end portion extending inwardly of the second side plane of the core and engaging the fourth inwardly extending surface, wherein the second side seal portion is connected to the middle portion of the second clip member.

2. The heat exchanger according to claim 1, wherein the top wall of the housing is spaced from the top of the core, and wherein the bypass seal further comprises:

(v) a top seal portion received between the top of the core and the top wall of the housing, wherein the top seal portion has an inner surface engaging the top of the core and an outer surface engaging the top wall of the housing.

3. The heat exchanger according to claim 2, wherein the top seal portion has one end which is connected to the first side seal portion and another end which is connected to the second side seal portion.

4. The heat exchanger according to claim 2, wherein at least the outer surface of the top seal portion is comprised of a resilient, foamed polymeric material.

5. The heat exchanger according to claim 2, wherein the top seal includes one or more apertures in its inner surface, and the top of the core includes one or more projections;

wherein each of the one or more projections is received in one of the one or more apertures.

6. The heat exchanger according to claim 1, wherein the first clip member and the second clip member are comprised of plastic or metal, and wherein one or both of the first side seal portion and the second side seal portion are comprised of a resilient, foamed polymeric material.

7. The heat exchanger according to claim 6, wherein the core, the first clip member and the second clip member are each comprised of an aluminum alloy or stainless steel, wherein the first and second end portions of the first clip member are brazed to the respective first and second inwardly extending surfaces of the core, and wherein the first and second end portions of the second clip member are brazed to the respective third and fourth inwardly extending surfaces of the core.

8. The heat exchanger according to claim 1, wherein the second end portions of the first and second clip members each comprise a contact portion engaging the core and an arcuate portion which is connected to the contact portion, which is spaced from the core, and which extends between the contact portion and the middle portion of the clip member.

9. The heat exchanger according to claim 8, wherein the second and fourth inwardly extending surfaces are each provided with a local projection protruding therefrom along the height of the core, wherein each said projection is located laterally between the contact portion of the first or second clip member and the respective first or second side plane.

10. The heat exchanger according to claim 1, wherein the first and third inwardly extending surfaces are each provided with one or more slots facing toward the respective first and second side planes, wherein each of the slots are axially spaced from the first and second side seal portions, and wherein the first end portion of each of the first and second clip members has an axially extending tip portion which is received within one of the slots.

11. The heat exchanger according to claim 10, wherein the slots are diagonally oriented relative to the axis.

12. The heat exchanger according to claim 11, wherein each of the first and third inwardly extending surfaces has a pair of slots, wherein the slots of each said pair are axially spaced apart and located on either side of the respective first and second side seal portions, and wherein the first end portion of each of the first and second clip members is flat and planar and has a pair of said tip portions extending axially in opposite directions and each received inside one of the slots.

13. The heat exchanger according to claim 6, wherein the middle portion of each of the first and second clip members includes one or more apertures, and wherein the first and second side seal portions each have one or more inwardly extending projections extending through and being retained by one of the one or more apertures of the middle portion.

14. The heat exchanger according to claim 3, wherein each of the first and second side seal portions includes an inner portion including the inner surface and an outer portion including the outer surface;

wherein the inner portions of the first and second side seal portions are integrally formed with the respective first and second clip members;

wherein the outer portions of the first and second side seal portions are integrally formed with the top seal portion; and wherein the inner and outer portions of each of the first and second side seal portions are connected together by connecting elements.

15. The heat exchanger according to claim 1, wherein the first and second side seal portions are integrally formed with the respective first and second clip members.

16. The heat exchanger according to claim 1, wherein the core includes a top plate which defines the top of the core and a bottom plate which defines the bottom of the core, and wherein the first and third inwardly extending surfaces are located on the top plate, and the second and fourth inwardly extending surfaces are located on the bottom plate.

17. The heat exchanger according to claim 16, wherein the bottom wall of the housing comprises a flange plate having a central portion and an upstanding peripheral flange, wherein the central portion is secured to the bottom plate of the core and the upstanding flange is spaced from the second and fourth inwardly extending surfaces, such that the second end portion of the first clip member is located between the upstanding flange and the second inwardly extending surface, and the second end portion of the second clip member is located between the upstanding flange and the fourth inwardly extending surface.

18. The heat exchanger according to claim 17, wherein the bypass seal further comprises a resilient bottom seal portion received between the upstanding flange of the flange plate and the bottom plate of the core, wherein the bottom seal portion has an inner surface engaging the bottom plate and an outer surface engaging the upstanding flange.

19. The heat exchanger according to claim 18, wherein the resilient bottom seal portion has one end which is connected to the first side seal portion and another end which is connected to the second side seal portion.

20. The heat exchanger according to claim 1, wherein the first fluid inlet is provided at the first end of the core and the first fluid outlet is provided at the second end of the core, and wherein the bypass seal is provided proximate to the first end of the core.

21. The heat exchanger according to claim 1, wherein each of the second fluid flow passages has opposed first and second sides which are closed;

wherein the first sides extend outwardly of the first side plane toward the first side wall of the housing, and wherein the second sides extend outwardly of the second side plane toward the second side wall of the housing; and wherein the inner surface of each of the first and second side seal portions includes a plurality of recesses to receive the first and second sides of the second fluid flow passages.

22. The heat exchanger according to claim 10, wherein each of the slots is formed in an edge of a flat bubble formed in the top plate;

wherein each of the tip portions of each of said first and second clip members has an aperture which is located within the flat bubble; and wherein a top surface of the flat bubble is provided with a dimple which extends into the aperture to prevent withdrawal of the tip portion from the slot.

* * * * *